United States Patent [19]

Okumura et al.

[11] Patent Number: 4,817,384

[45] Date of Patent: Apr. 4, 1989

[54] DOUBLE AIR-FUEL RATIO SENSOR SYSTEM HAVING IMPROVED EXHAUST EMISSION CHARACTERISTICS

[75] Inventors: Atsuo Okumura; Masato Ujino; Takashi Kawase, all of Toyota, Japan

[73] Assignee: Toyota Jidosha Kabushiki Kaisha, Aichi, Japan

[21] Appl. No.: 84,105

[22] Filed: Aug. 11, 1987

[30] Foreign Application Priority Data

| | | | |
|---|---|---|---|
| Aug. 13, 1986 | [JP] | Japan | 61-188759 |
| Oct. 13, 1986 | [JP] | Japan | 61-241488 |
| Jan. 21, 1987 | [JP] | Japan | 62-009930 |
| Feb. 20, 1987 | [JP] | Japan | 62-035820 |

[51] Int. Cl.[4] ..... F02D 41/14

[52] U.S. Cl. ..... 60/274; 60/276; 60/285; 123/489

[58] Field of Search ..... 123/440, 489, 589; 60/274, 276, 285; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,251,989 | 2/1981 | Norimatsu et al. | 123/440 |
| 4,462,373 | 7/1984 | Kanno | 123/489 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,625,698 | 12/1986 | Jamrog | 123/489 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72647 | 4/1983 | Japan . |
| 58-72646 | 4/1983 | Japan . |
| 58-135343 | 8/1983 | Japan . |
| 58-152147 | 9/1983 | Japan . |
| 58-150039 | 9/1983 | Japan . |
| 58-150038 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar

*Attorney, Agent, or Firm*—Parkhurst, Oliff & Berridge

[57] ABSTRACT

In a double air-fuel sensor system including two air-fuel ratio sensors upstream and downstream of a catalyst converter provided in an exhaust gas passage, an air-fuel ratio correction amount is calculated in accordance with the outputs of the upstream-side and downstream-side air-fuel ratio sensors, thereby obtaining an actual air-fuel ratio. The air-fuel ratio correction amount is guarded within a predetermined range. When this correction amount reaches the maximum or minimum value of the range, the calculation of the air-fuel ratio correction amount by the output of the downstream-side air-fuel ratio sensor is prohibited.

58 Claims, 29 Drawing Sheets

| Fig. 3A | Fig. 3B | Fig. 3C |
|---|---|---|

LEAN
RICH
A/F
TDR
CDLY 0
t1
t2
t3
t4
t5
t6
t7
t8
TDL
A/F'
(F1)

TDR
LEAN
RICH
(-TDL)
TDR

RSL
KIR
FAF1
RSR
KIL

| Fig. 5A | Fig. 5B | Fig. 5C | Fig. 5D |
|---|---|---|---|

| Fig. 8 A | Fig. 8 B | Fig. 8 C |
|---|---|---|

LEAN
RICH
A/F
TDL
CDLY 0
t1
t2
t3
t4
t5
t6
t7
t8
TDR
A/F'
(F1)
(-TDR)
TDL
(-TDR)

LEAN
RICH
KIR
KIL
FAF1

RSL
RSR

DOUBLE AIR-FUEL RATIO SENSOR SYSTEM HAVING IMPROVED EXHAUST EMISSION CHARACTERISTICS

BACKGROUND OF THE INVENTION (1) Field of the Invention

The present invention relates to a method and apparatus for feedback control of an air-fuel ratio in an internal combustion engine having two air-fuel ratio sensors upstream and downstream of a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalsyt converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emmision characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, for example, an air-fuel ratio feedback control parameter such as a rich skip amount RSR and/or a lean skip amount RSL is calculated in accordance with the output of the downstream-side $O_2$ sensor, and an air-fuel ratio correction amount FAF is calculated in accordance with the output of the upstream-side $O_2$ sensor and the air-fuel ratio feedback control parameter. In this case, the air-fuel ratio feedback control parameter is stored in a backup random access memory (RAM). Therefore; when the downstream-side $O_2$ sensor is brought to a non-activation state or the like to stop the calculation of the air-fuel ratio feedback control parameter by the downstream-side $O_2$ sensor, the air-fuel ratio correction amount FAF is calculated in accordance with the output of the upstream-side $O_2$ sensor and the air-fuel ratio feedback control parameter stored in the backup RAM (see Japanese Unexamined Patent Publication (Kokai) No. 61-192828, which corresponds to Japanese Patent Application No. 60-32863, which in turn corresponds to U.S. patent application Ser. No. 831,566 filed Feb. 21, 1986, Further, when the air-fuel ratio feedback control parameter is too large or too small, the transient characteristics of the parameter are reduced, or the drivability is deteriorated by the fluctuation of the air-fuel ratio. To avoiding this, the air-fuel ratio feedback parameter is guarded within a predetermined range defined by a maximum value and a minimum value (see Japanese Unexamined Patent Publication No. 61-234241, corresponding to Japanese Patent Application No. 60-74439, which in turn corresponds to U.S. patent application No. 848,580 filed Apr. 7, 1986.

In an internal combustion engine having an evaporative emission control system, however, when the temperature within a fuel tank is relatively high so that a large amount of fuel vapor is generated therein, such vapor is drawn into a combustion chamber of the engine through a canister by a purge system, and thus the air-fuel ratio becomes too rich. When this state continues, the air-fuel ratio correction amount FAF is inclined to the lean side by the output of the upstream-side $O_2$ sensor and is held at a minimum value such as 0.8 by which the controlled air-fuel ratio is prevented from becoming overlean. Also, in this case, since it is impossible to completely control the air-fuel ratio by the air-fuel ratio correction amount FAF ,the air-fuel ratio feedback control parameter is also inclined to the lean side. In this state, it is assumed that the engine is stopped and then restarted, to reach a normal driving state. As a result, since the air-fuel ratio correction amount FAF is calculated by using the lean-inclined air-fuel ratio feedback control parameters stored in the backup RAM, the speed of increase of the air-fuel ratio correction amount FAF is relatively small. In addition, since the temperature within the fuel tank is relatively low because the engine has been stopped, so that only a little fuel vapor remains in the fuel tank, the output of the downstream-side $O_2$ sensor maintains a lean signal for a certain period, thus increasing the $NO_X$ emission and reducing the drivability.

Thus, when the air-fuel ratio correction amount FAF is held at the maximum or minimum value of a range by the evaporative emission control system or the like, it is basically impossible for a double $O_2$ sensor system to detect a deviation of a mean value of the controlled air-fuel ratio, compared with a desired air-fuel ratio such as a stoichiometric air-fuel ratio, and obtain same. Further, if the determination of whether or not the downstream-side $O_2$ sensor is activated is dependent upon whether or not the output thereof is once changed from the lean side to the rich side, or vice versa, the feedback control for the air-fuel ratio feedback control parameter by the output of the downstream-side $O_2$ sensor is delayed, thus increasing the exhaust gas emissions, reducing the drivability, and deteriorating the fuel consumption characteristics.

SUMMARY OF THE INVENTION

It is an object of the present invention to provide a double air-fuel ratio sensor system having an improved exhaust emission, drivability, and fuel consumption characteristics.

Therefore, according to the present invention, in a double air-fuel-sensor system including two air-fuel ratio sensors upstream and downstream of a catalyst converter provided in an exhaust gas passage, an air-fuel ratio correction amount FAF is calculated in accordance with the outputs of the upstream-side and downstream-side air-fuel ratio sensors, to thereby obtain an actual air-fuel ratio. The air-fuel ratio correction amount FAF is guarded within a predetermined range, and when this correction amount reaches the maximum or minimum value of the range, the calculation of the air-fuel ratio correction amount by the output of the downstream-side air-fuel ratio sensor is prohibited, i.e., the air-fuel ratio feedback control by the downstream-side air-fuel ratio sensor is stopped.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
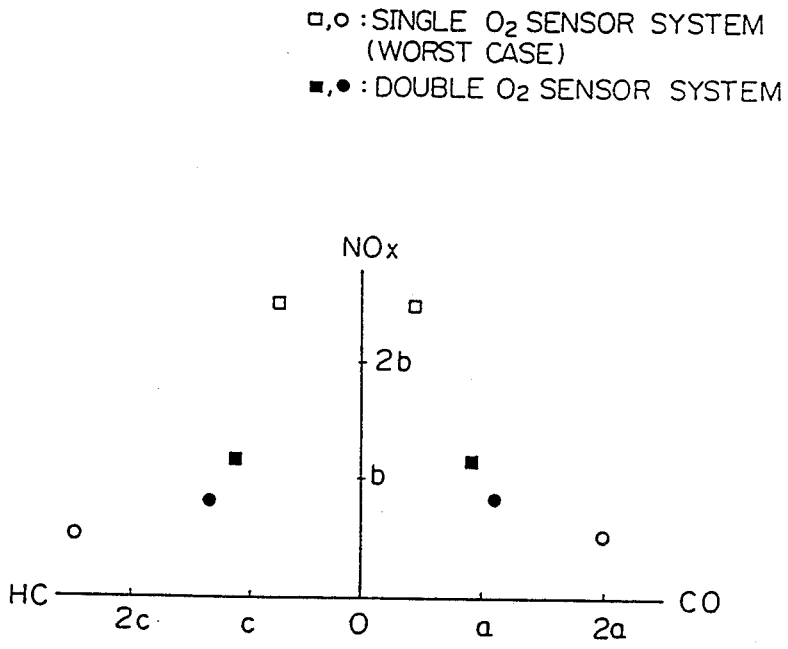
FIG. 1 is a graph showing the emission characteristics of a single $O_2$ sensor system and a double $O_2$ sensor system.
Figure 2:
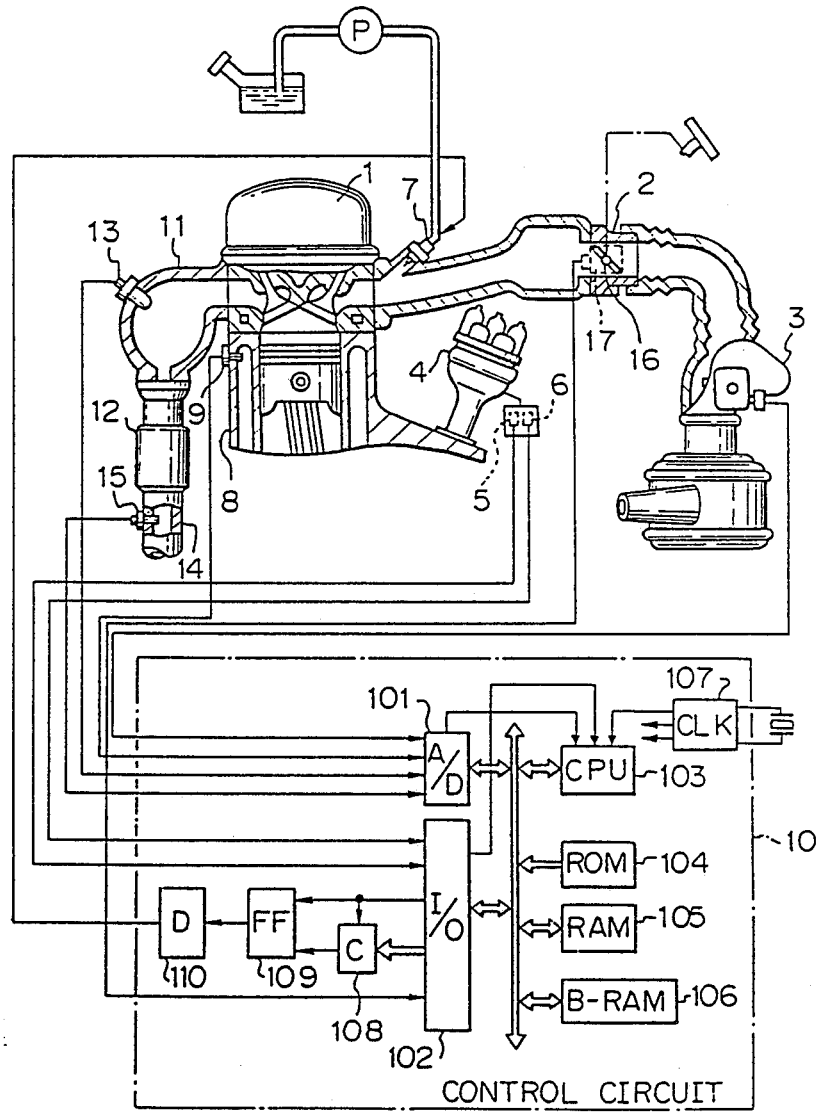
FIG. 2 is a schematic view of an internal combustion engine according to the present invention.

In FIG. 2, which illustrates an internal combustion engine according to the present invention, reference numerals 1 designates a four-cycle spark ignition engine disposed in an automative vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit those signals to the A/D converter 101 of the control circuit 10.

Reference 16 designates a throttle valve, and 17 an idle switch for detecting whether or not the throttle valve 16 is completely closed.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, an interface 102 of the control circuit 10.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the fip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 10 of FIG. 2 will be now explained.

Figures 3, 3A:
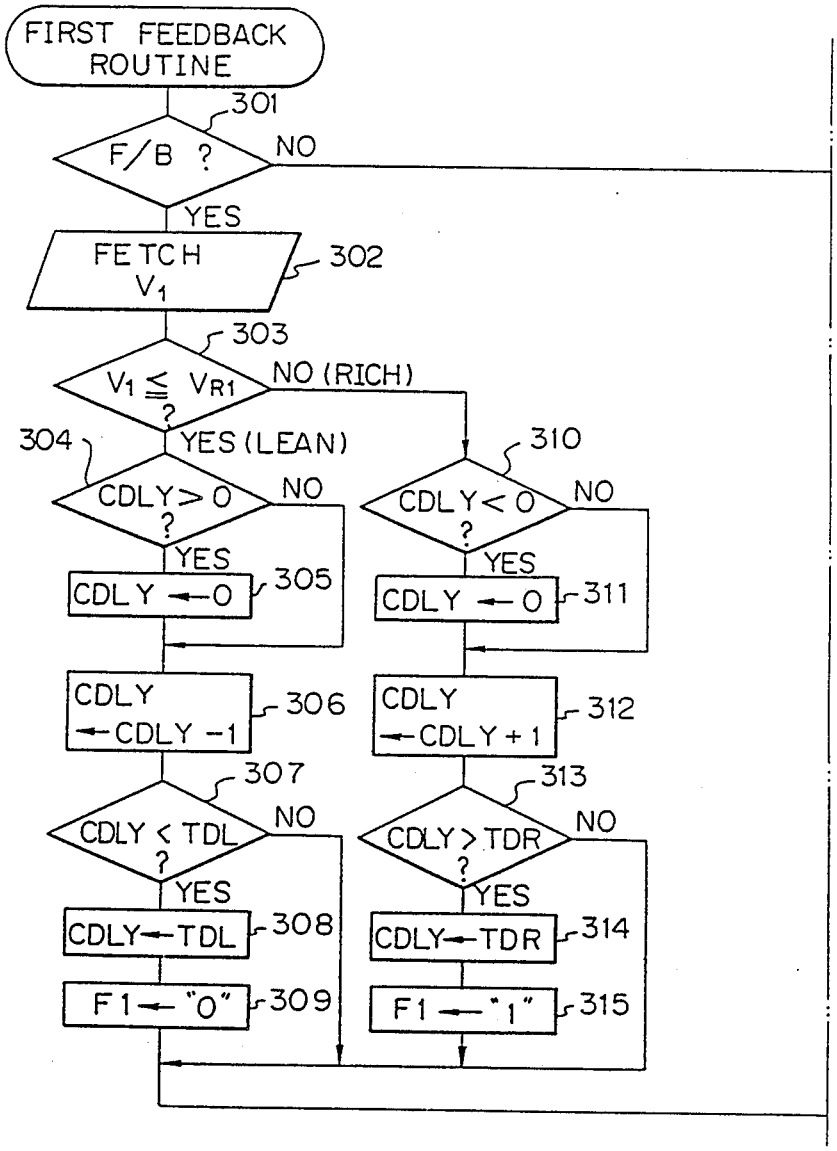
FIGS. 3, 3A–3C, 5, 5A–5D, 6, 8, 8A–8C, 9, 14, 16, 18, 20, and 22 are flow charts showing the operation of the control circuit of FIG. 2.
Figure 3B:
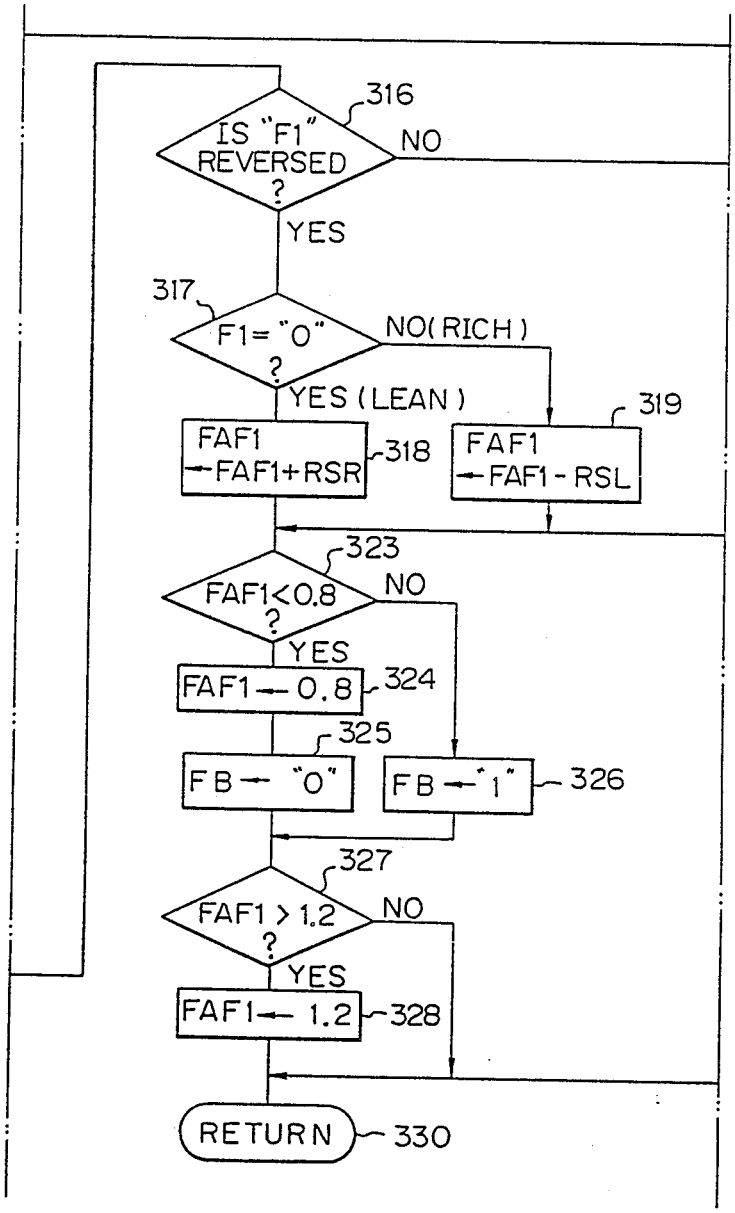
Figure 3C:
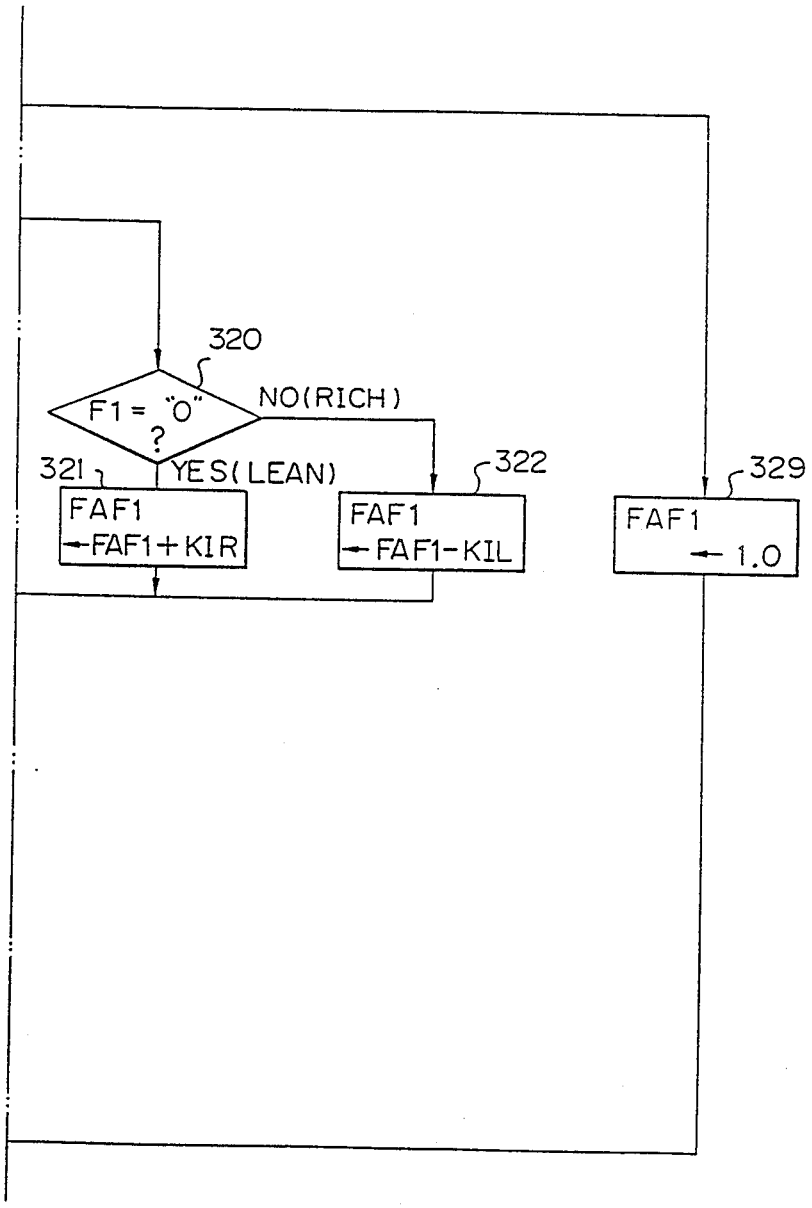

FIG. 3 is a routine for calculating a first air-fuel ratio feedback correction amount FAF1 in accordance with output of the upstream-side $O_2$ sensor 13 executed at every predetermined time period such as 4 ms.

At step 301, it is determined whether or not all of the feedback control (closed-loop control) conditions by the upstream-side $O_2$ sensor 13 are satisfied. The feedback control conditions are as follows:

(i) the engine is not in a starting state;

(ii) the coolant temperature THW is higher than 50° C.;

(iii) the power fuel incremental amount FPOWER is 0; and (iv) the upstream-side $O_2$ sensor 13 is in an activated state.

Note that the determination of activation/non-activation of the upstream-side $O_2$ sensor 13 is carried out by determining whether or not the coolant temperature THW≧70° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one of more of the feedback control conditions is not satisfied, the control proceeds to step 329, in which the amount FAF1 is caused to be 1.0 (FAF1=1.0), thereby carrying out an open-loop control operation. Note that, in this case, the amount FAF1 can be a value or a mean value immediately before the open-loop control operation. That is, the amount FAF1 or a mean value FAF1 thereof is stored in the backup RAM 106, and in an open-loop control operation, the value FAF1 or $\overline{FAF1}$ is read out of the backup RAM 106.

Contrary to the above, at step 301, if all of the feedback control conditions are satisfied, the control proceeds the step 302.

At step 302, an A/D conversion is performed upon the output voltage $V_1$ of the upstream-side $O_2$ sensor 13, and the A/D converted value thereof is then fetched from the A/D converter 101. Then at step 303, the voltage $V_1$ is compared with a reference voltage $V_{R1}$ such as 0.45 V, thereby determining whether the current air-fuel ratio detected by the upstream-side $O_2$ current 13 is on the rich side or on the lean side with respect to the stoichiometric air-fuel ratio.

If $V_1 \leqq V_{R1}$, which means that the current air-fuel ratio is lean, the control proceeds to step 304, which determines whether or not the value of a delay counter CDLY is positive. If CDLY>0, the control proceeds to step 305, which clears the delay counter CDLY, and then proceeds to step 306. If CDLY≦0, the control proceeds directly to step 306. At step 306, the delay counter CDLY is counted down by 1, and a step 307, it is determined whether or not CDLY<TDL. Note that TDL is a lean delay time period for which a rich state is maintained even after the output of the upstream-side $O_2$ sensor 13 is changed from the rich side to the lean side, and is defined by a negative value. Therefore, at step 307, only when CDLY<TDL does the control proceed to step 308, which causes CDLY to be TDL, and then to step 309, which causes a first air-fuel ratio flag F1 to be "0" (lean state). On the other hand, if $V_1 > V_{R1}$, which means that the current air-fuel ratio is rich, the control proceeds to step 310, which determines whether or not the value of the delay counter CDLY is negative. If CDLY<0, the control proceeds to step 311, which clears the delay counter CDLY, and then proceeds to step 312. If CDLY≧0, the control directly proceeds to 312. At step 312, the delay counter CDLY is counted up by 1, and at step 313, it is determined whether or not CDLY>TDR. Note that TDR is a rich delay time period for which a lean state is maintained even after the output of the upstream-side $O_2$ sensor 13 is changed from the lean side to the rich side, and is defined by a positive value. Therefore, at step 313, only when CLDY>TDR does the control proceed to step 314, which causes CDLY to the TDR, and then to step 315, which causes the first air-fuel ratio flag F1 to be "1" (rich state).

Next, at step 316, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 317 to 319, which carry out a skip operation.

At step 317, if the flag F1 is "0" (lean) the control proceeds to step 318, which remarkably increases the correction amount FAF1 by a skip amount RSR. Also, if the flag F1 is "1" (rich) at step 317, the control proceeds to step 319, which remarkably decreases the correction amount FAF1 by the skip amount RSL.

On the other hand, if the first air-fuel ratio flag F1 is not reversed at step 316, the control proceeds to step 320 to 322, which carries out an integration operation. That is, if the flag F1 is "0" (lean) at step 320, the control proceeds to step 321, which gradually increases the correction amount FAF1 by a rich integration amount KIR. Also, if the flag F1 is "1" (rich) at step 320, the control proceeds to step 322, which gradually decreases the correction amount FAF1 by a lean integration amount KIL.

The correction amount FAF1 is guarded by a minimum value 0.8 at steps 323 and 324. In this case, when the correction amount FAF1 reaches the minimum value 0.8, the control proceeds to step 325 which resets an air-fuel ratio feedback execution flag FB by the downstream-side $O_2$ sensor 15. Alternatively, the control proceeds to step 326 which sets the feedback execution flag F2. Also the correction amount FAF1 is guarded by a maximum value 1.2 at steps 327 and 328. Thus, the controlled air-fuel ratio is prevented from becoming overlean or overrich.

The correction amount FAF1 is then stored in the RAM 105, thus completing this routine of FIG. 3 at steps 330.

Note that it is also possible to set the feedback execution flag FB when the air-fuel ratio correction amount FAF1 reaches the maximum value 1.2.

Figures 4A, 4B, 4C, 4D:
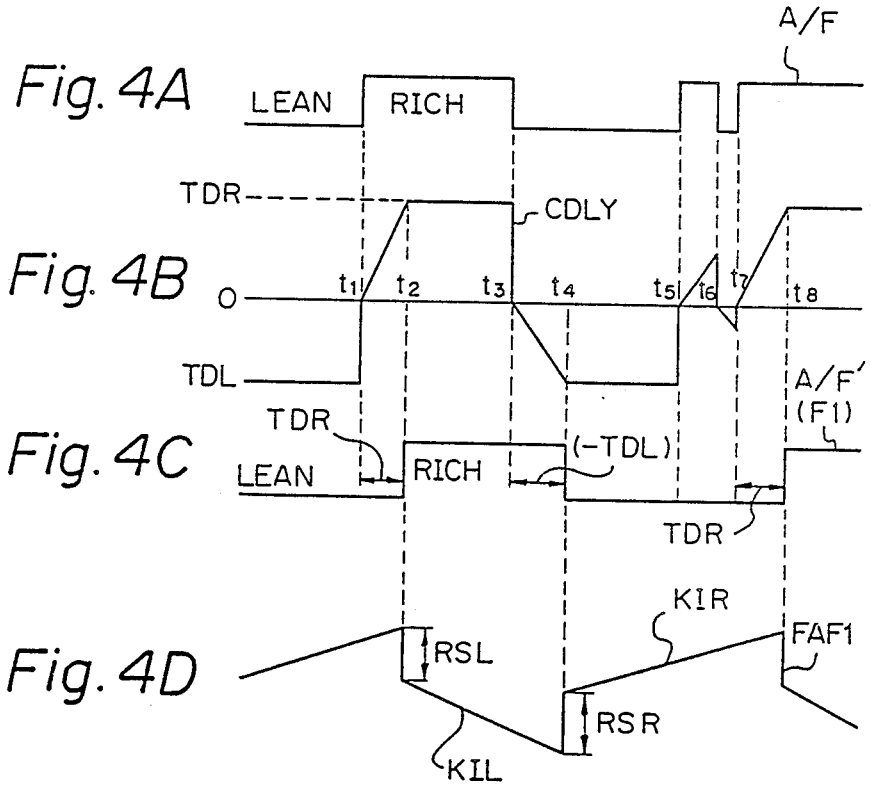
FIGS. 4A through 4D are timing diagrams explaining the flow chart of FIG. 3.

The operation by the flow chart of FIG. 3 will be further explained with reference to FIGS. 4A through 4D. As illustrated in FIG. 4A, when the air-fuel ratio A/F is obtained by the output of the upstream-side $O_2$ sensor 13, the delay counter CDLY is counted up during a rich state, and is counted down during a lean state, as illustrated in FIG. 4B. As a result, a delayed air-fuel ratio corresponding to the first air-fuel ratio flag F1 is obtained as illustrated in FIG. 4C. For example, at time $t_1$, even when the air-fuel ratio A/F is changed from the lean side to the rich side, the delayed air-fuel ratio A/F' (F1) is changed at time $t_2$ after the rich delay time period TDR. Similarly, at time $t_3$, even when the air-fuel ratio A/F is changed from the rich side to the lean side, the delayed air-fuel ratio F1 is changed at time $t_4$ after the lean delay time period TDL. However, at time $t_5$, $t_6$, or $t_7$, when the air-fuel ratio A/F is reversed within a shorter time period than the rich delay time period TDR or the lean delay time period TDL, the delay air-fuel ratio A/F' is reversed at time $t_8$. That is, the delayed air-fuel ratio A/F' is stable when compared with the air-fuel ratio A/F. Further, as illustrated in FIG. 4D, at every change of the delayed air-fuel ratio A/F' from the rich side to the lean side, or vice versa, the correction amount FAF is skipped by the skip amount RSR or RSL, and in addition, the correction amount FAF1 is gradually increased or decreased in accordance with the delayed air-fuel ratio A/F'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR and the lean delay time period TDL), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich delay time period becomes longer than the lean delay time period (TDR>(−TDL)), the controlled air-fuel becomes richer, and if the lean delay time period becomes longer than the rich delay time period ((−TDL)>TDR), the controlled air-fuel ratio becomes leaner. Thus, the air-fuel ratio can be controlled by changing the rich delay time period TDR1 and the lean delay time period (−TDL) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output downstream-side $O_2$ sensor 15. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

A double $O_2$ sensor system into which a second air-fuel ratio correction amount FAF2 is introduced will be explained with reference to FIGS. 5 and 6.

Figures 5, 5A:
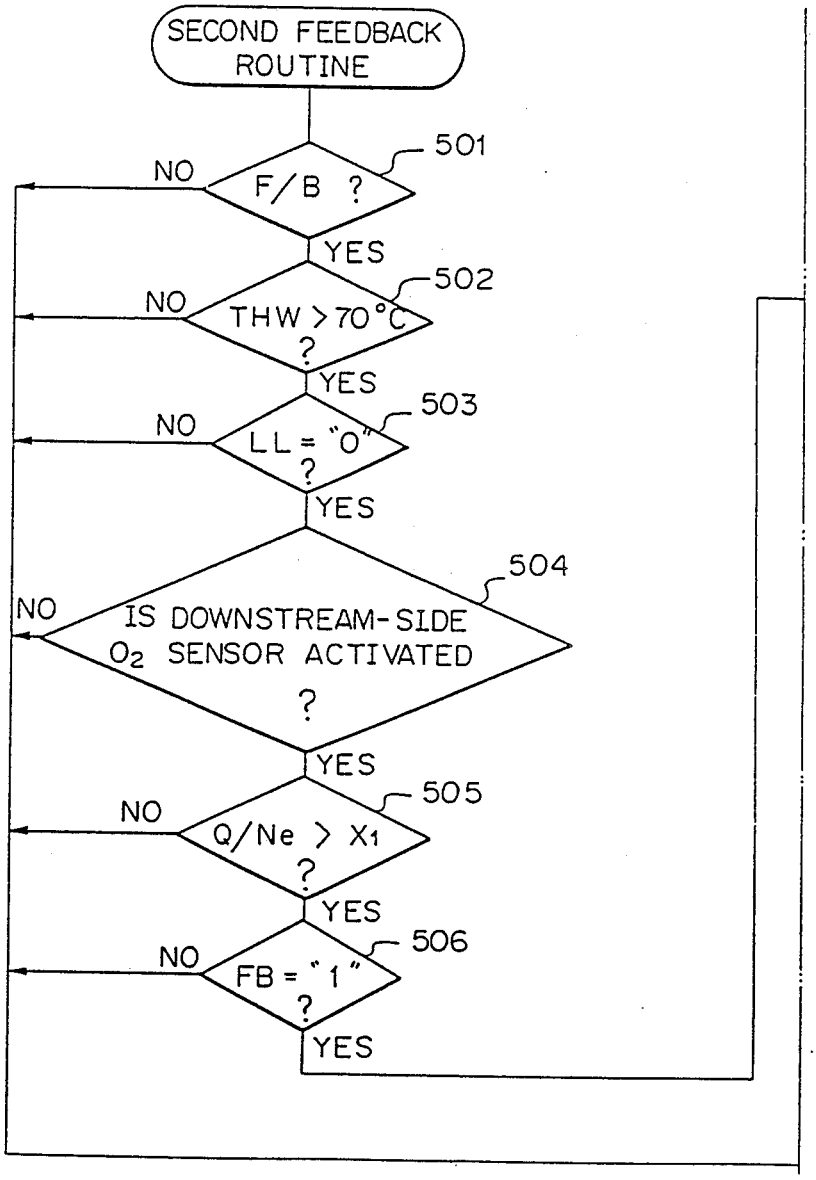
Figure 5B:
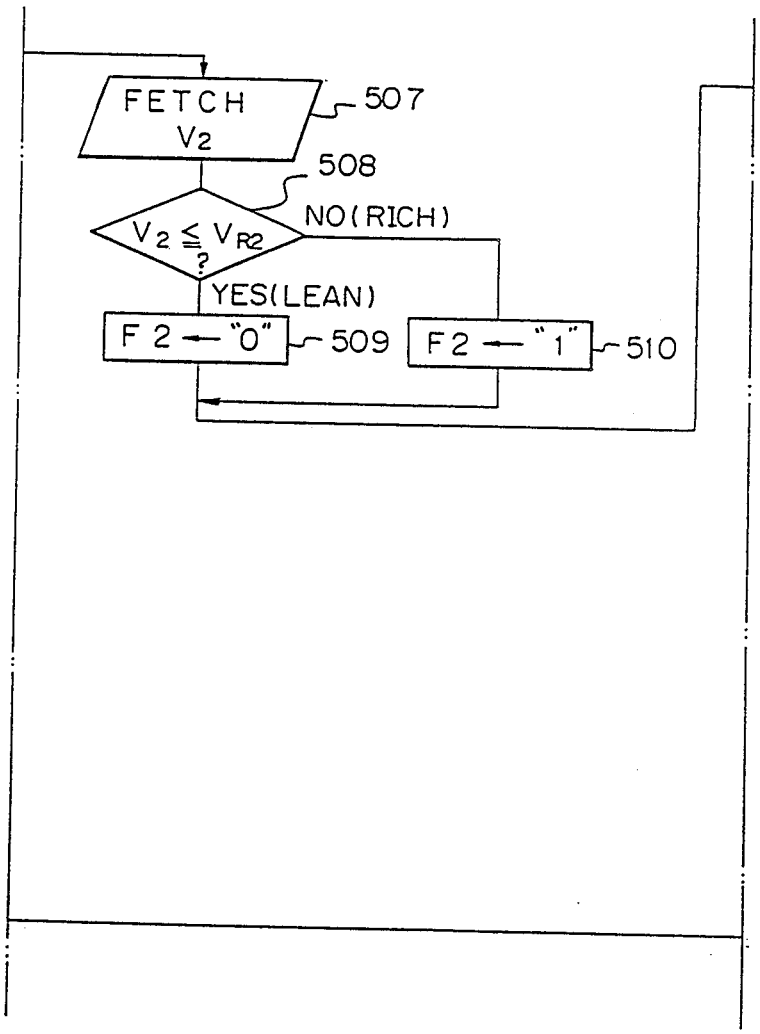
Figure 5C:
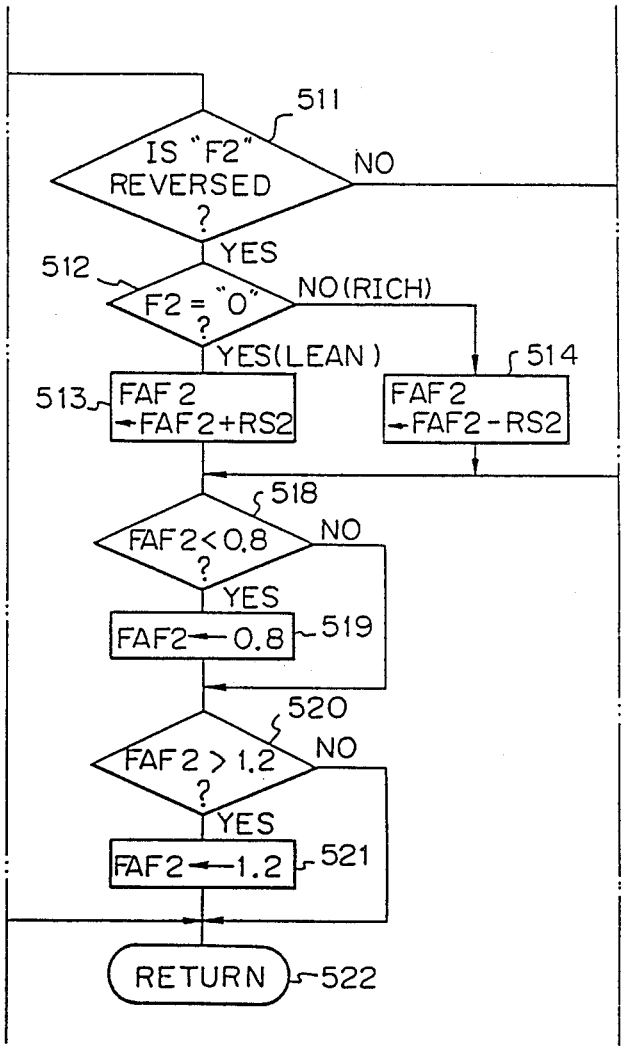
Figure 5D:
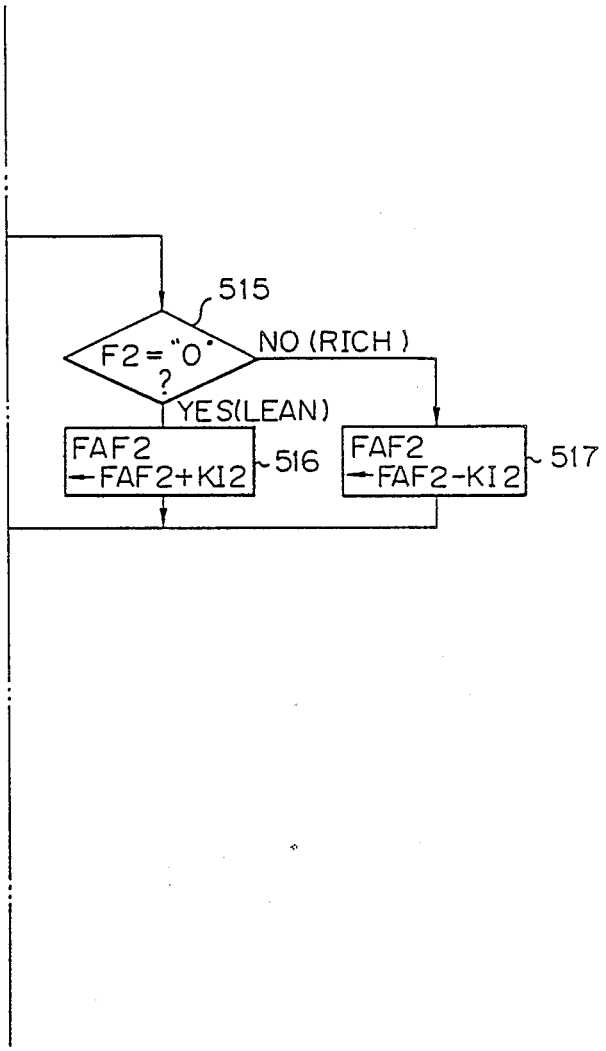

FIG. 5 is a routine for calculating a second air-fuel ratio feedback correction amount FAF2 in accordance with the output of the downstream-side $O_2$ sensor 15 executed at every predetermined time period such as 1 s.

At steps 501 through 505, it is determined whether or not all of the feedback control (closed-loop control) conditions by the downstream-side $O_2$ sensor 15 are satisifed. For example, at step 501, it is determined whether or not the feedback control conditions by the upstream-side $O_2$ sensor 13 are satisfied. At step 502, it is determined whether or not the coolant temperature THW is higher than 70° C. At step 503, it is determined whether or not the throttle valve 16 is open (LL="0"). At step 504, it is determined whether or not the output of the downstream-side $O_2$ sensor 15 has been once changed from the lean side to the rich side or vice versa. At step 505, it is determined whether or not a laod parameter such as Q/Ne is larger than a predetermined value X. Of course, other feedback control conditions are introduced as occasion demands. However, an explanation of such other feedback control conditions is omitted.

If one or more of the feedback control conditions is not satisfied, the control proceeds directly to step 522, thereby carrying out an open-loop control operation. Note that, in this case, the amount FAF2 or a mean value FAF2 thereof is stored in the backup RAM 106, and in an open-loop control operation, the value FAF2 or $\overline{FAF2}$ is read out of the backup RAM 106.

Contrary to the above, if all of the feedback control conditions are satisfied, the control proceeds to step 506.

At step 506, it is determined whether or not the feedback execution flag FB is "1", i.e., whether or not the air-fuel ratio correction amount FAF1 has reached 0.8. If FB="0", the control proceeds directly to step 522. Alternatively, the control proceeds to step 507.

At step 507, an A/D conversion is performed upon the output voltage $V_2$ of the downstream-side $O_2$ sensor 15, and the A/D converted value thereof is then fetched from the A/D converter 101. Then, at step 508, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12. However, the voltage $V_{R2}$ can be voluntarily determined.

At step 508, if the air-fuel ratio is lean, the control proceeds to step 509 which resets a second air-fuel ratio flag F2. Alternatively, the control proceeds to the step 510, which sets the second air-fuel ratio flag F2.

Next, at step 511, it is determined whether or not the second air-fuel ratio flag F2 is reversed, i.e., whether or not the air-fuel ratio detected by the downstream-side $O_2$ sensor 15 is reversed. If the second air-fuel ratio flag F2 is reversed, the control proceeds to steps 512 to 514 which carry out a skip operation. That is, if the flag F2 is "0" (lean) at step 512, the control proceeds to step 513, which remarkably increases the second correction amount FAF2 by a skip amount RS2. Also, if the flag F2 is "1" (rich) at step 512, the control proceeds to step 514, which remarkably decreases the second correction amount FAF2 by the skip amount RS2. On the other hand, if the second air-fuel ratio flag F2 is not reversed at step 511, the control proceeds to steps 515 to 517, which carry out an integration operation. That is, if the flag F2 is "0" (lean) at step 515, the control proceeds to step 516, which gradually increases the second correction amount FAF2 by an integration amount KI2. Also, if the flag F2 is "1" (rich) at step 515, the control proceeds to step 517, which gradually decreases the second correction amount FAF2 by the integration amount KI2.

Note that the skip amount RS2 is larger than the integration amount KI2.

The second correction amount FAF2 is guarded by a minimum value 0.8 at steps 518 and 519, and by a maximum value 1.2 at steps 520 and 521, thereby also preventing the controlled air-fuel ratio from becoming overrich or overlean.

The correction amount FAF2 is then stored in the backup RAM 106, thus completing this routine of FIG. 5 at step 522.

Figure 6:
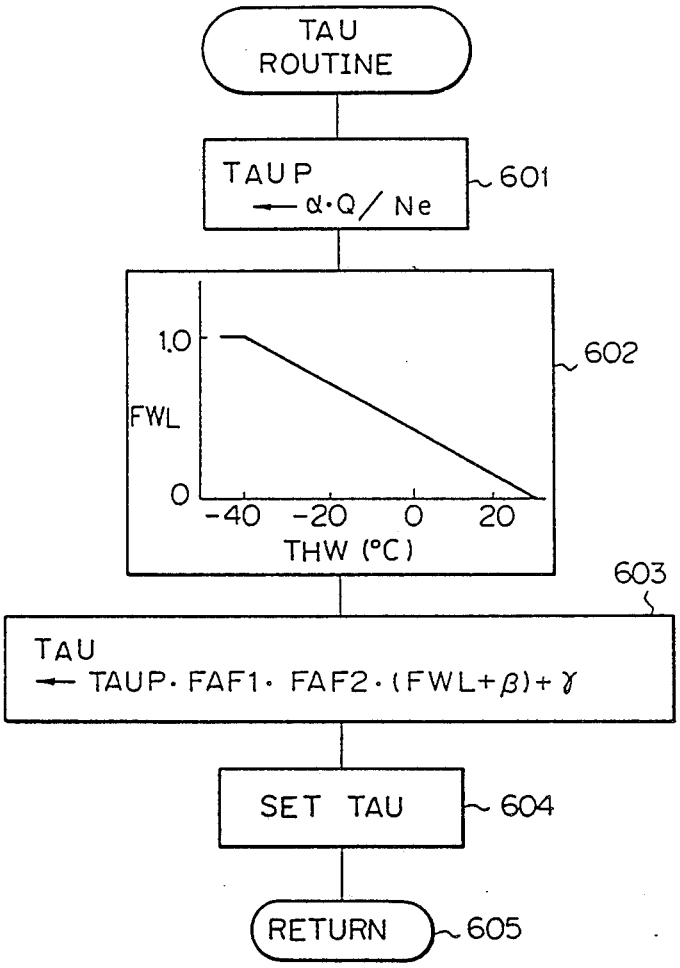

FIG. 6 is a routine for calculating a fuel injection amount TAU executed at every predetermined crank angle such as 360° CA. At step 601, a base fuel injection amount TAUP is calculated by using the intake air amount data Q and the engine speed data Ne stored in the RAM 105. That is, $$TAUP \leftarrow \alpha . Q/Ne$$

where $\alpha$ is a constant. Then at step 602, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 603, a final fuel injection amount TAU is calculated by $$TAU \leftarrow TAUP.FAF1.FAF2.(FWL+\beta)+\gamma$$

where $\beta$ and $\gamma$ are correction factors determined by other parameters such as the voltage of the battery and the temperature of the intake air. At step 604, the final fuel injection amount TAU is set in the down counter 107, and in addition, the flip-flop 108 is set to initiate the activation fo the fuel injection valve 7. Then, this routine is completed by step 605. Note that, as explained above, when a time period corresponding to the amount TAU has passed, the flip-flop 109 is reset by the carry-out signal of the down counter 108 to stop the activation of the fuel injection valve 7.

Figures 7A, 7B, 7C, 7D, 7E, 7F, 7G:
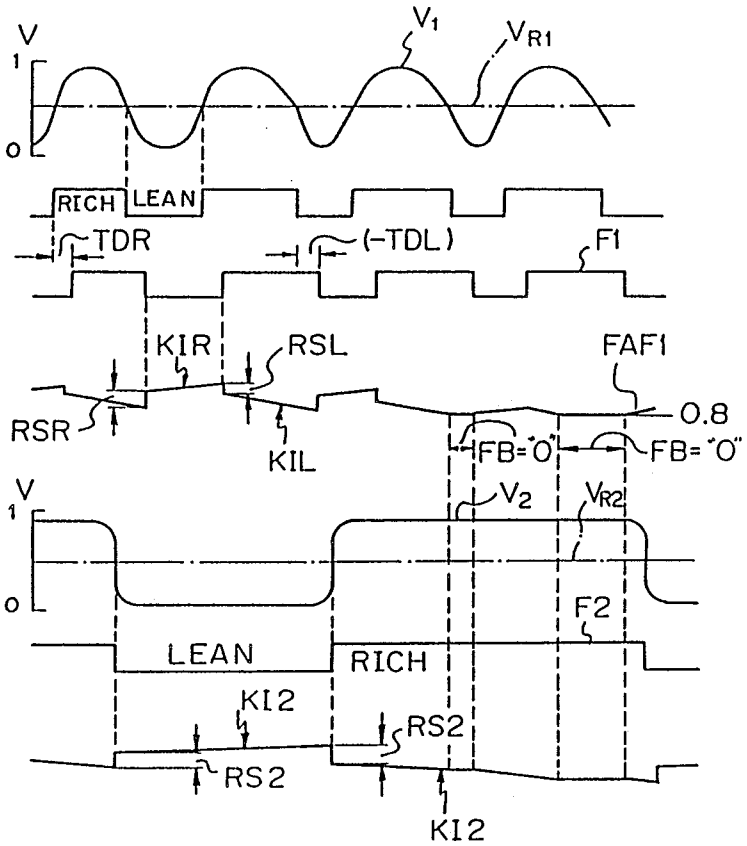
FIGS. 7A through 7G are timing diagrams explaining the flow charts of FIGS. 3, 5, and 6.

FIGS. 7A through 7G are timing diagrams for explaining the two air-fuel ratio correction amounts FAF1 and FAF2 obtained by the flow charts of FIGS. 3, 5, and 6. In this case, the engine is in a closed-loop control state for the two $O_2$ sensors 13 and 15. When the output of the upstream-side $O_2$ sensor 13 is changed as illustrated in FIG. 7A, the determination at step 303 of FIG. 3 is shown in FIG. 7B, and a delayed determination thereof corresponding to the first air-fuel ratio flag F1 is shown in FIG. 7C. As a result, as shown in FIG. 7D, every time the delayed determination is changed from the rich side to the lean side, or vice versa, the first air-fuel ratio correction amount FAF1 is skipped by the amount RSR or RSL. Otherwise, the first air-fuel ratio correction amount FAF1 is gradually changed by the amount KIR or KIL. In this case, when the air-fuel ratio correction amount FAF1 reaches the minimum value 0.8 of an allowable range, the feedback execution flag FB is reset (FB="0") is illustrated in FIG. 7D.

On the other hand, when the output of the downstream-side $O_2$ sensor 15 is changed as illustrated in FIG. 7E, the determination at 508 of FIG. 5 corresponding to the second air-fuel ratio flag F2 is shown in FIG. 7F. As a result, as shown in FIG. 7G, every time the determination is changed from the rich side to the lean side, or vice versa, the second air-fuel ratio correction amount FAF2 is skipped by the skip amount RS2. Alternatively, the second air-fuel ratio correction amount FAF2 is gradually changed by the integration amount KI2. In this case, as illustrated in FIG. 7G, the calculation of the second air-fuel ratio correction amount FAF2 is stopped when the feedback execution flag FB is "0".

A double $O_2$ sensor system, in which an air-fuel ratio feedback control parameter of the first air-fuel ratio feedback control by the upstream-side $O_2$ sensor is variable, will be explained with reference to FIGS. 8 and 9. In this case, the skip amounts RSR and RSL as the air-fuel ratio feedback control parameters are variable.

Figures 8, 8A:
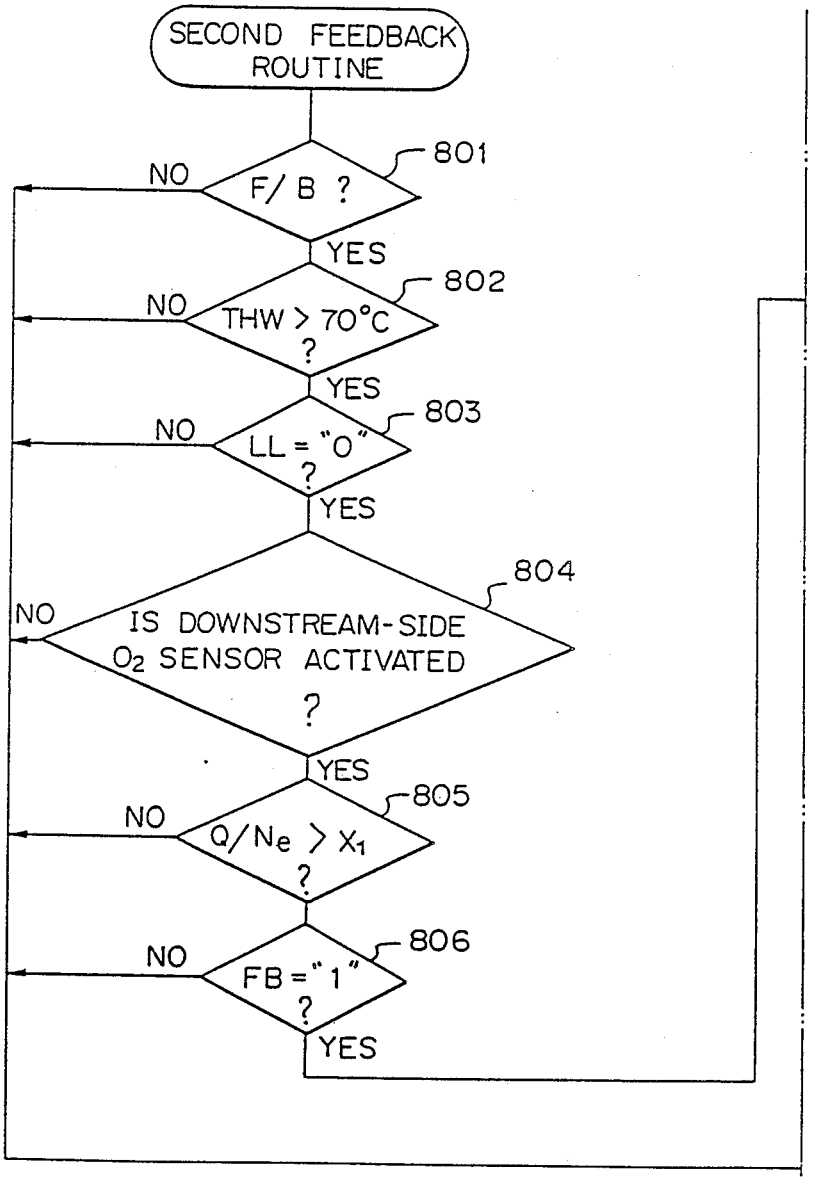
Figure 8B:
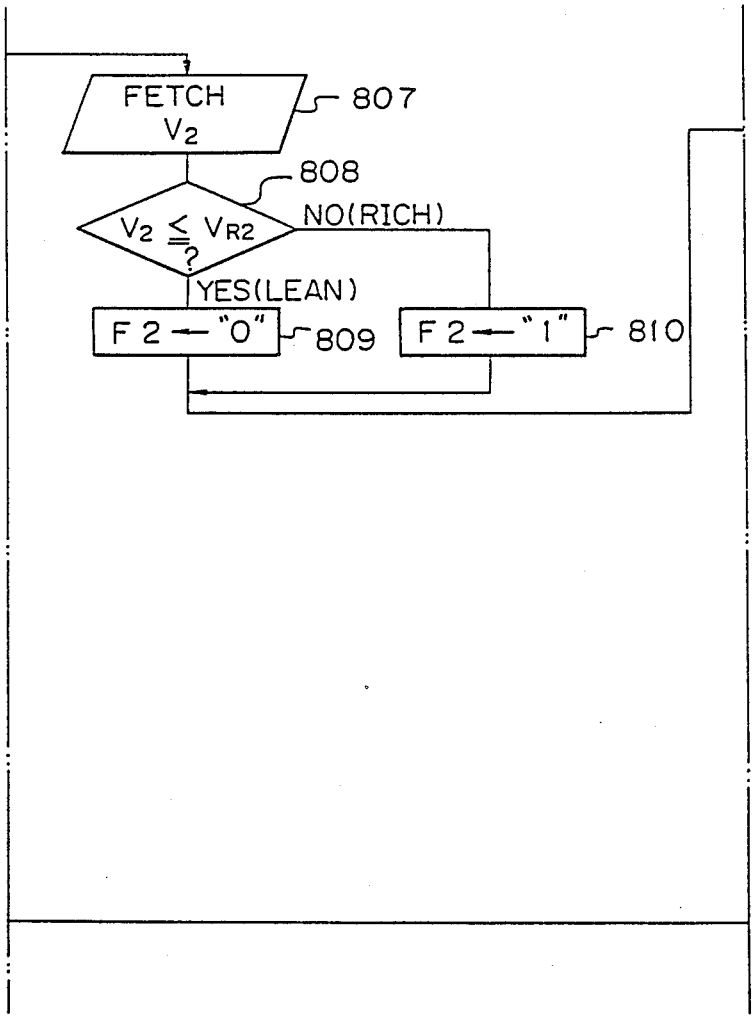
Figure 8C:
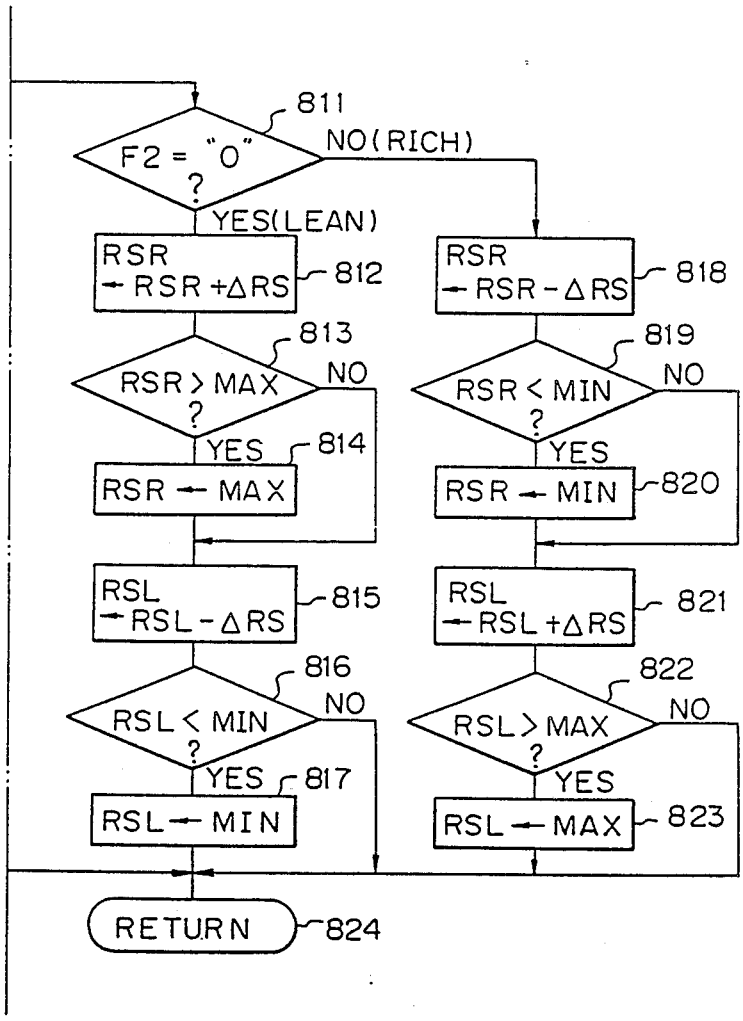

FIG. 8 is a routine for calculating the skip amounts RSR and RSL in accordance with the output of the downstream-side $O_2$ sensor 15 executed at every predetermined time period such as 1 s.

Steps 801 through 810 are the same as steps 501 through 510 of FIG. 5. That is, if one or more of the feedback control conditions is not satisfied, the control proceeds directly to step 824, thereby carrying out an open-loop control operation. Note that, in this case, the amounts RSR and RS or the mean values $\overline{RSR}$ and $\overline{RSL}$ thereof are stored in the backup RAM 106, and in an open-loop control operation, the values RSR and RSL or $\overline{RSR}$ and $\overline{RSL}$ are read out of the backup RAM 106.

Contrary to the above, if all of the feedback control conditions are satisfied, the second air-fuel ratio flag F2 is determined by the routine of steps 807 through 810.

At step 811, it is determined whether or not the second air-fuel ratio F2 is "0". If F2="0", which means that the air-fuel ratio is lean, the control proceeds to steps 812 through 817, and if F2="1", which means that the air-fuel ratio is rich, the control proceeds to steps 818 through 823.

At step 812, the rich skip amount RSR is increased by a definite value $\Delta$RS which is, for example, 0.08, to move the air-fuel ratio to the rich side. At steps 813 and 814, the rich skip amount RSR is guarded by a maximum value MAX which is, for example, 6.2%.

At step 815, the lean skip amount RSL is decreased by the definite value $\Delta$RS to move the air-fuel ratio to the rich side. At steps 816 and 817, the lean skip amount RSL is guarded by a minimum value MIN which is, for example, 2.5%.

On the other hand, if F2="1" (rich), at step 818, the rich skip amount RSR is decreased by the definite value $\Delta$RS to move the air-fuel ratio to the lean side. At steps 819 and 820, the rich skip amount RSR is guarded by the minimum value MIN. Further, at step 821, the lean skip amount RSL is decreased by the definite value $\Delta$RS to move the air-fuel ratio to the rich side. At steps 822 and 823, the lean skip amount RSL is guarded by the maximum value MAX.

The skip amounts RSR and RSL are then stored in the backup RAM 106, thereby completing this routine of FIG. 8 at step 824.

Thus, according to the routine of FIG. 8, when the delayed output of the second $O_2$ sensor 15 is lean, the rich skip amount RSR is gradually increased, and the lean skip amount RSL is gradually decreased, thereby moving the air-fuel ratio to the rich side. Conversely, when the output of the second $O_2$ sensor 15 is rich, the rich skip amount RSR is gradually decreased, and the lean skip amount RSL is gradually increased, thereby moving the air-fuel ratio to the lean side. In this case, when the air-fuel ratio correction amount FAF1 reaches the minimum value 0.8, the calculation of the skip amounts RSR and RSL is prohibited.

Figure 9:
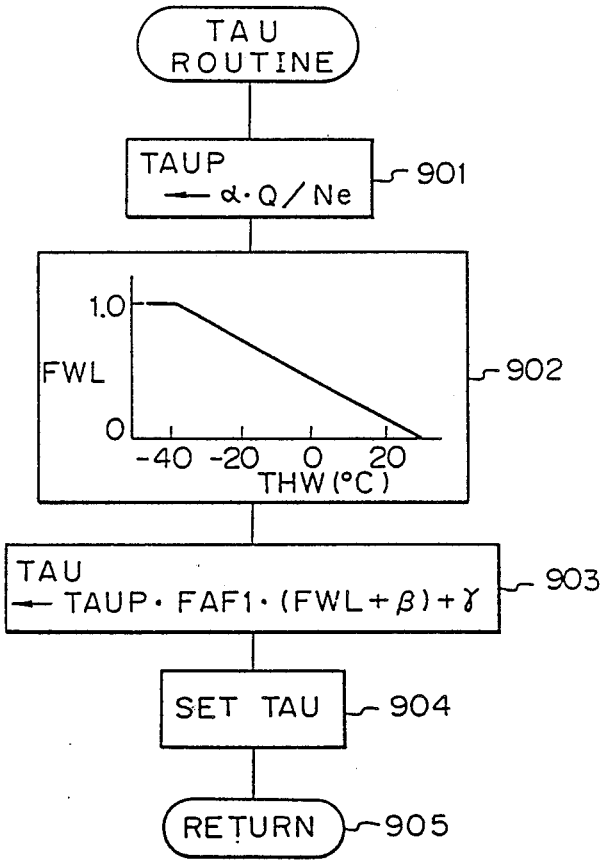

FIG. 9 is a routine for calculating a fuel injection amount TAU executed at every predetermined crank angle such as 360° CA. At step 901, a base fuel injection amount TAUP is calculated by using the intake air amount data Q and the engine speed data Ne stored in the RAM 105. That is, $$TAUP \leftarrow \alpha . Q/Ne$$

where $\alpha$ is a constant. Then at step 902, a warming-up incremental amount FWL is calculated from a one-dimensional map by using the coolant temperature data THW stored in the RAM 105. Note that the warming-up incremental amount FWL decreased when the coolant temperature THW increases. At step 903, a final fuel injectional amount TAU is calculated by $$TAU \leftarrow TAUP.FAF1.(FWL+\beta)+\gamma$$

where $\beta$ and $\gamma$ are correction factors determined by other parameters such as the voltage of the battery and the temperature of the intake air. At step 904, the final fuel injection amount TAU is set in the down counter 108, and in addition, the flip-flop 109 is set to initiate the activation of the fuel injection valve 7. This routine is then completed by step 905. Note that, as explained above, when a time period corresponding to the amount TAU has passed, the flip-flop 109 is reset by the carry-out signal of the down counter 108 to stop the activation of the fuel injection valve 7.

Figures 10A, 10B, 10C, 10D, 10E, 10F, 10G, 10H:
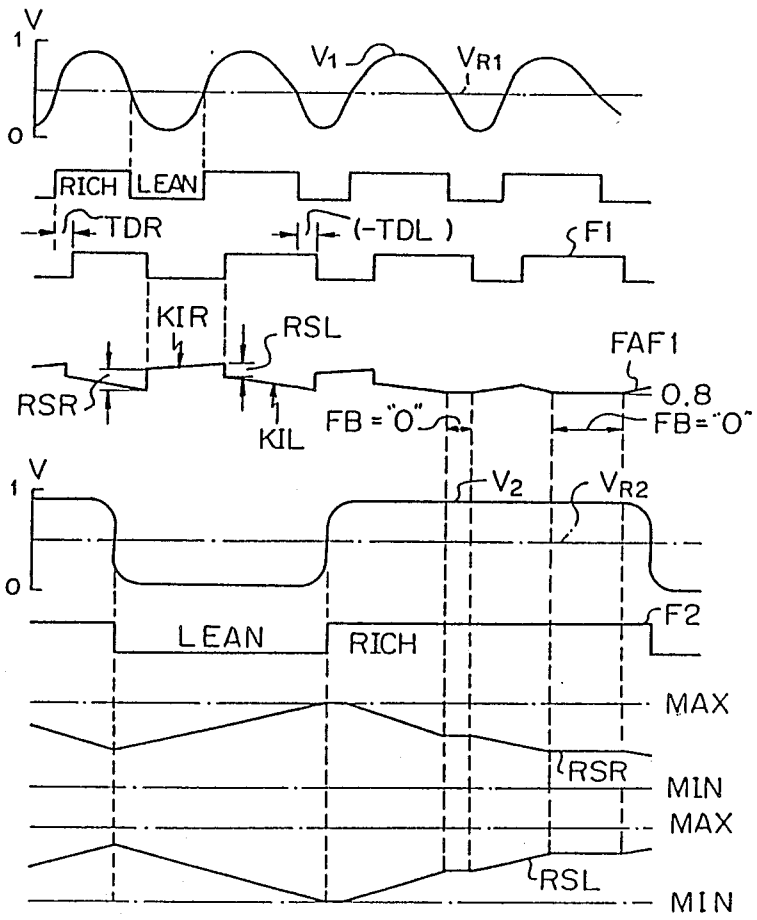
FIGS. 10A through 10H are timing diagrams explaining the flow charts of FIGS. 3, 8, and 9.

FIGS. 10A through 10H are timing diagrams for explaining the air-fuel ratio correction amount FAF1 and the skip amounts RSR and RSL obtained by the flow charts of FIGS. 3, 8 and 9. FIGS. 10A through 10F are the same as FIG. 7A through 7F, respectively. As shown in FIGS. 10G and 10H, when the determination at step 508 is lean, the rich skip amount RSR is increased and the lean skip amount RSL is decreased, and when the determination at step 508 is rich, the rich skip amount RSR is decreased and the lean skip amount RSL is increased. In this case, the skip amounts RSR and RSL are changed within a range of from MAX to MIN. Also in this case, as illustrated in FIGS. 10G and 10H, the calculation of the skip amounts RSR and RSL is stopped when the feedback execution flag FB is "0".

Figure 11:
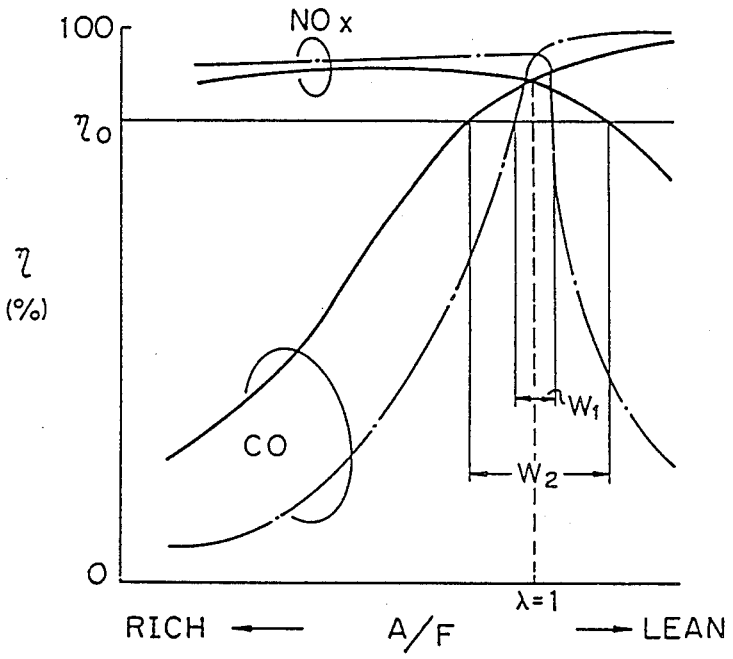
FIG. 11 is a graph showing the $O_2$ storage effect of three-way catalysts.
Figure 12:
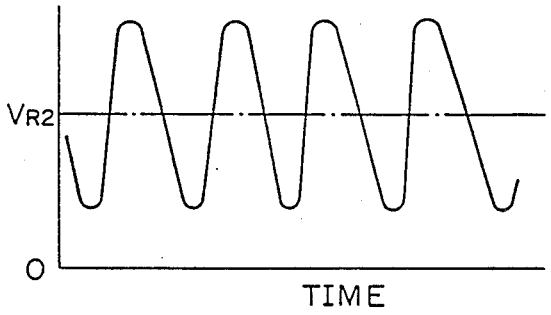
FIGS. 12 and 13 are timing diagrams of the output of the downstream-side $O_2$ sensor.
Figure 13:
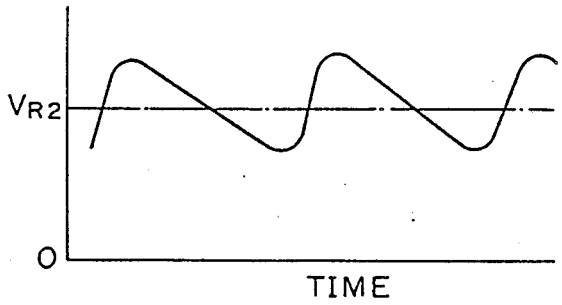

The cleaning rate characteristics of the three-way catalyst converter 12 of FIG. 2 will be explained with reference to FIGS. 11, 12, and 13. In FIG. 11, the ordinate $\eta$ represents the catalytic cleaning rate, and the abscissa A/F represents the air-fuel ratio of the exhaust gas. That is, as illustrated by dotted lines, when the air-fuel ratio is on the rich side with respect to the stoichiometric air-fuel ratio ($\lambda=1$), the cleaning rate $\eta$ of the $NO_X$ emission is increased, but when the air-fuel ratio is on the lean side with respect to the stoichiometric air-fuel ratio, the cleaning rate of the HC and CO emissions is increased (although HC is not shown, it has the same tendency as CO). As a result, if $\eta_0$ is an optimum cleaning rate, the controlled air-fuel ratio window is within a very narrow width $W_1$. However, the three-way catalysts have an $O_2$ storage effect whereby, when the air-fuel ratio is lean these catalysts absorb oxygen, and when the air-fuel ratio is rich they absorb and react HC and CO with the already absorbed oxygen. Therefore, since an air-fuel ratio feedback control makes positive use of this $O_2$ storage effect to obtain an optimum frequency and amplitude of the controlled air-fuel ratio, the cleaning rate $\eta$ is improved and thus the controlled air-fuel ratio window ($W=W_2$) is substantially increased. In this case, the output of the downstream-side $O_2$ sensor 15 has a frequency of about 2 Hz, as shown in FIG. 12.

However, when the downstream-side $O_2$ sensor 15 is deteriorated, so that very little oxygen is absorbed into zirconia elements of the sensor 15, a delay occurs in the output $V_2$ of the downstream-side $O_2$ sensor 15 when the air-fuel ratio downstream of the catalyst converter 12 is switched from the rich state to the lean state. That is, a transition from a maximum level to a minimum level takes a long time, as shown in FIG. 13. In this case, the air-fuel ratio downstream of the catalyst converter 12 becomes rich before the output $V_2$ of the downstream-side $O_2$ sensor 15 is sufficiently lowered, thus reducing the frequency of the output of the downstream-side $O_2$ sensor 15. As a result, the controlled air-fuel ratio window is also reduced (For example, $W=W_1$).

Thus, the response speed of the downstream-side $O_2$ sensor 15 is reduced, compared with that of the upstream-side $O_2$ sensor 13, due to the location thereof, the $O_2$ storage effect of the catalyst converter 12, the deterioration of the downstream-side $O_2$ sensor 15, and the like. That is, when the air-fuel ratio downstream of the catalyst converter 12 corresponding to the output of the downstream-side $O_2$ sensor 15 is switched from the lean side to the rich side, the air-fuel ratio upstream of the catalyst converter 12 is already greatly deviated from the stoichiometer air-fuel ratio to the rich side, thus increasing the HC and CO emissions and the fuel consumption. Conversely, when the air-fuel ratio downstream of the catalyst converter 12 is switched from the rich side to the lean side, the air-fuel ratio upstream of the catalyst converter 12 is already greatly deviated from the stoichiometric air-fuel ratio to the lean side, thus increasing the $NO_X$ emission and reducing the drivability.

Figure 14:
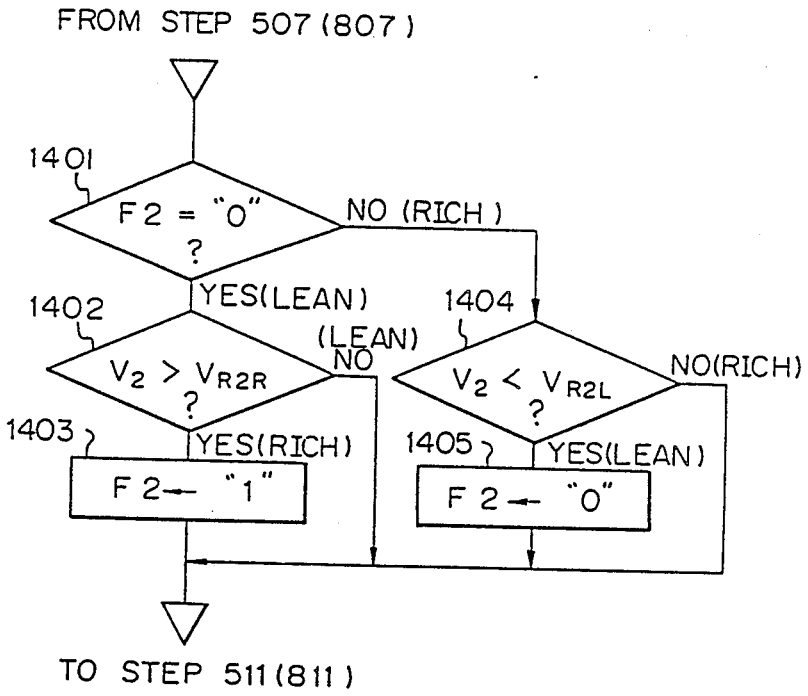

In order to substantially enhance the response speed of the downstream-side $O_2$ sensor 15, two reference voltages $V_{R2R}$ and $V_{R2L}$ are provided for the output $V_2$ of the downstream-side $O_2$ sensor 15. That is, as illustrated in FIG. 14, which is a modification of FIGS. 5 and 9, at step 1401, it is determined whether or not the second air-fuel ratio flag F2 is "0" (lean). If F2="0" (lean), the control proceeds to step 1402 which determines whether or not, $$V_2>V_{R2R},$$

where $V_{R2R}$ is used for detecting a transition of the air-fuel ratio from the lean side to the rich side, and is, for example, 0.3 V. Only when $V_2>V_{R2R}$, does the control proceed to step 1403, which sets the second air-fuel ratio flag F2. On the other hand, at step 1401, if F2="1" (rich), the control proceeds to step 1404 which determines whether or not $$V_2<V_{R2L}.$$

where $V_{R2L}$ is used for detecting a transition of the air-fuel ratio from rich side to the lean side, and is, for example, 0.6 V. Only when $V_2<V_{R2L}$, does the control proceed to step 1405, which resets the second air-fuel ratio flag F2.

Figures 15A, 15B, 15C:
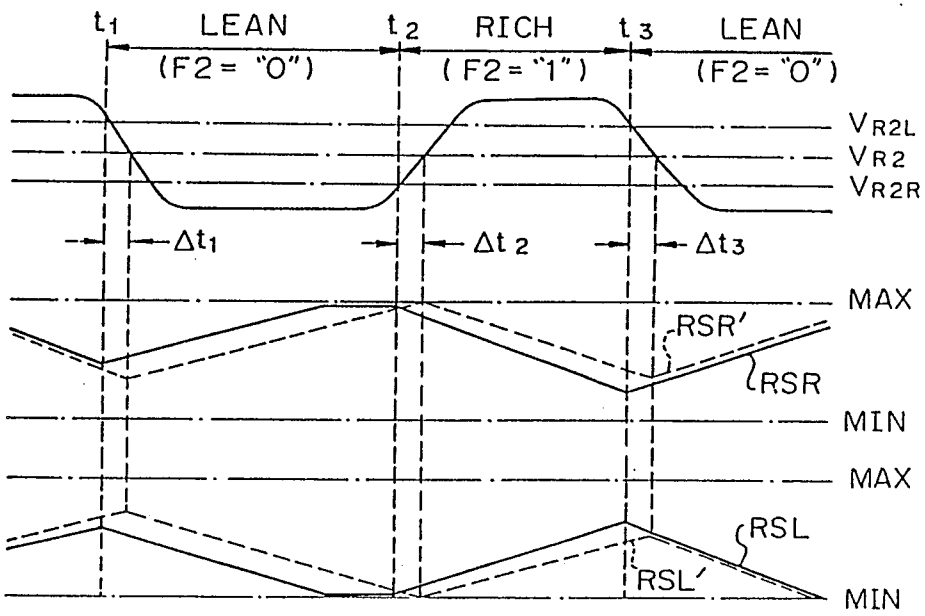
FIGS. 15A, 15B, and 15C are timing diagrams explaining the flowchart of FIG. 14.

The combination of the routines of FIGS. 9 and 14 will be explained with reference to FIGS. 15A, 15B, and 15C. As illustrated in FIG. 15A, when the output $V_2$ of the downstream-side $O_2$ sensor 15 crosses the lean determination level $V_{R2L}$ at times $t_1, t_3, \ldots$, and crosses the rich determination level $V_{R2R}$ at times $t_2, \ldots$, the second air-fuel ratio flag F2 is made "0" (lean) at times $t_1, t_3, \ldots$, and is made "1" (rich) at times $t_2, \ldots$. As a result, as illustrated in FIGS. 15B and 15C, when F2="0", the rich skip amount RSR is gradually increased and the lean skip amount RSL is gradually decreased, and when F2="1", the rich skip amount RSR is gradually decreased and the lean skip amount RSL is gradually increased.

Thus, a transition of the air-fuel ratio downstream of the catalyst converter 12 from the rich side to the lean side, or vice versa, can be detected earlier by $\Delta t_1, \Delta t_2, \Delta t_3, \ldots$ compared with the case where only one reference level $V_{R2}$ is provided to obtain the rich skip amount RSR' and the lean skip amount RSL'. This means that the response speed of the downstream-side $O_2$ sensor 15 is substantially increased.

In FIG. 14, if the downstream-side $O_2$ sensor 15 is deteriorated, so that the amplitude thereof is small, the output $V_2$ of the downstream-side $O_2$ sensor 15 may be maintained between the rich and lean determination levels $V_{R2R}$ and $V_{R2L}$. As a result, it is impossible to detect a transition of the air-fuel ratio downstream of the catalyst converter 12, and accordingly, a lean determination or a rich determination is maintained for a certain period so that the skip amounts RSR and RSL are held at the maximum value or the minimum value, and thus, an air-fuel ratio feedback control by the downstream-side $O_2$ sensor 15 cannot be normally carried out.

Figure 16:
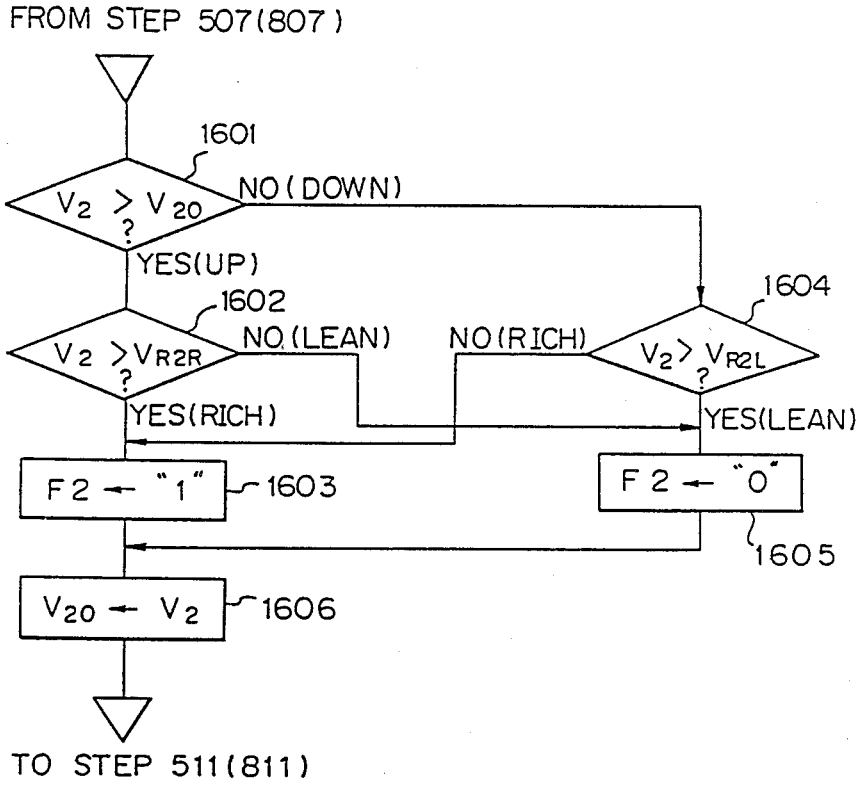

In view of the deterioration of the downstream-side $O_2$ sensor 15, a flow chart of FIG. 16 is used instead of FIG. 14. That is, at step 1601, it is determined whether or not $$V_2>V_{20}$$

where $V_{20}$ is a previously fetched value of the output $V_2$ of the downstream-side $O_2$ sensor 15. If $V_2>V_{20}$ (UP), the control proceeds to step 1602, but if $V_2 \leqq V_{20}$ (DOWN), the control proceeds to step 1604.

At step 1602, if $V_2>V_{R2R}$, the control proceeds to step 1603 which sets the second air-fuel ratio flag F2, but if $V_2 \leqq V_{R2R}$, the control proceeds to step 1605 which resets the second air-fuel ratio flag F2. Similarly, at step 1604, if $V_2<V_{R2L}$, the control proceeds to step 1605 and which resets the second air-fuel ratio flag F2, but if $V_2 \geqq V_{R2}$, the control proceeds to step 1603 which sets the second air-fuel ratio flag F2. At step 1606, $V_2$ is made $V_{20}$, thus preparing for a next execution.

Figures 17A, 17B, 17C:
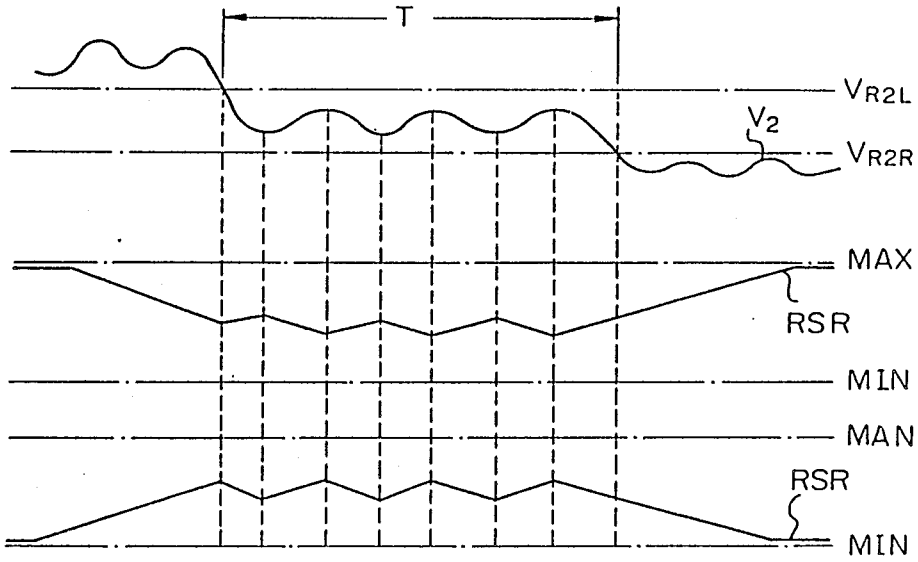
FIGS. 17A, 17B, and 17C are timing diagrams explaining the flow chart of FIG. 16.

Thus, when the flow chart of FIG. 16 is applied to the routine of FIG. 8, the skip amounts RSR and RSL are also changed as shown in FIGS. 15A, 15B, and 15, where the output $V_2$ of the downstream-side $O_2$ sensor 15 has a large amplitude. However, if the downstream-side $O_2$ sensor 15 is deteriorated so that the output $V_2$ of the downstream-side $O_2$ sensor 15 has a small amplitude, the rich skip amount RSR and the lean skip amount RSL are changed as illustrated in FIGS. 17A, 17B, and 17C, thus reducing the amplitude of the controlled air-fuel ratio. That is, as illustrated in FIG. 17A, even when the amplitude of the output $V_2$ of the downstream-side $O_2$ sensor 15 is small for a period T, the control at step 1602 is switched to the control at step 1604 or vice versa in accordance with whether the output $V_2$ of the downstream-side $O_2$ sensor 15 is ascending or descending, and accordingly, the air-fuel ratio determination by the downstream-side $O_2$ sensor 15 is switched. Thus, the rich skip amount RSR and the lean skip amount RSL are not held at the maximum value MAX or the minimum value MIN, thereby carrying out a normal air-fuel ratio feedback control operation.

Note that, in FIG. 16, if the determination at step 1602 or 1604 is negative, the control can proceed directly to step 1606.

Figure 18:
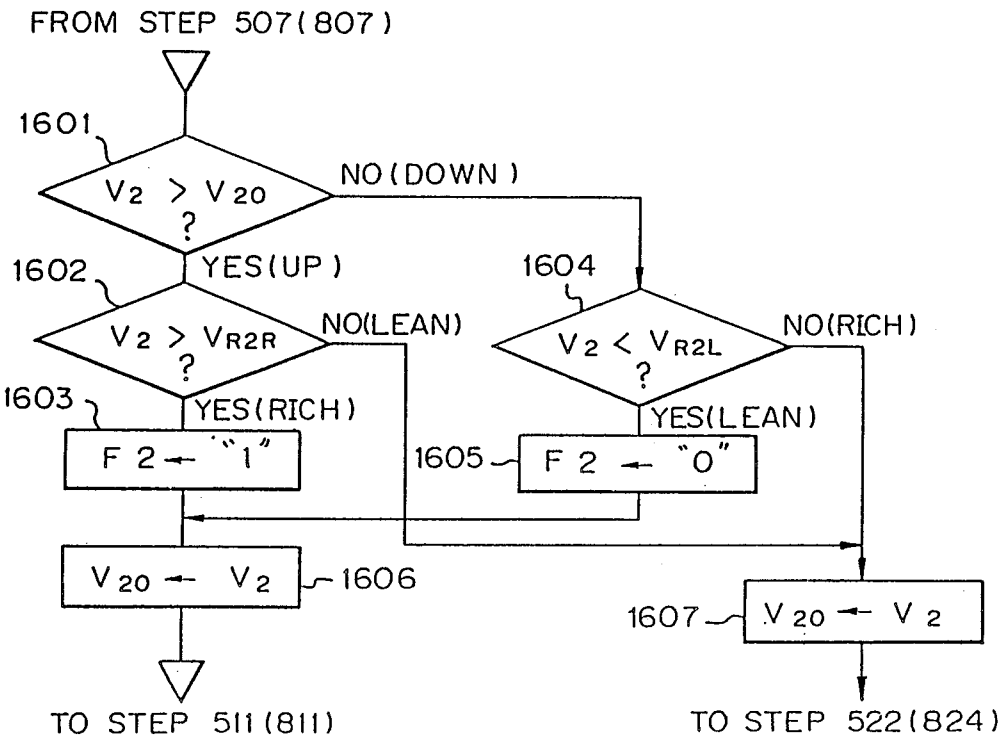
Figures 19A, 19B, 19C:
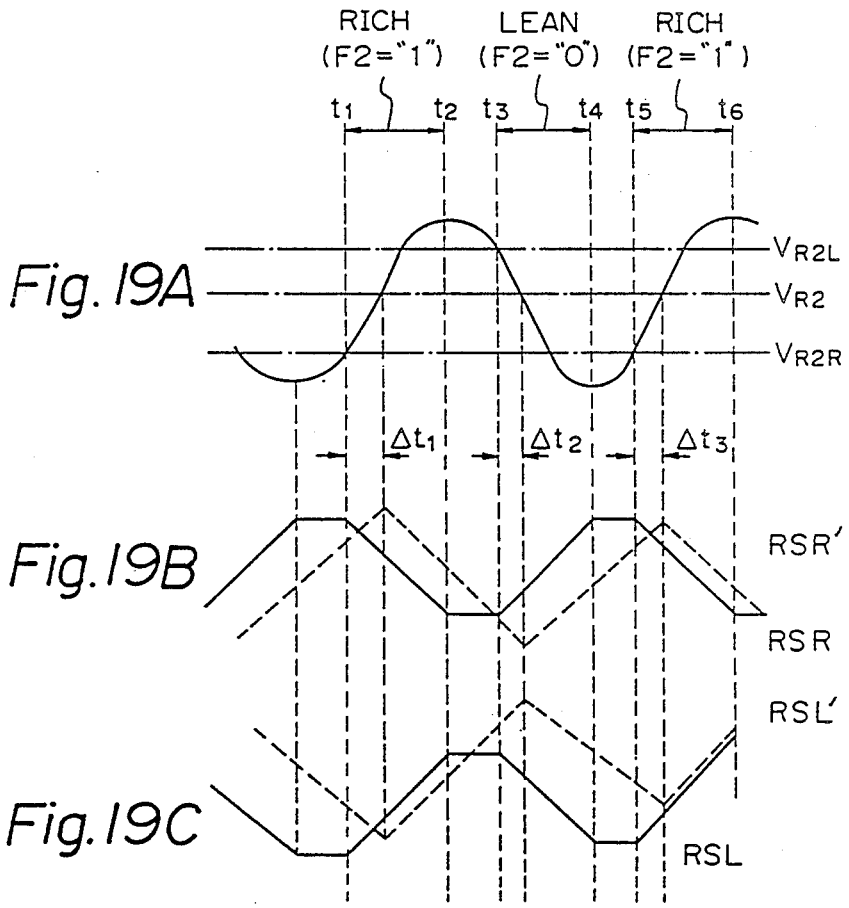
FIGS. 19A, 19B, and 19C are timing diagrams explaining the flow chart of FIG. 18.

In FIG. 18, which is a modification of FIG. 16, if the determination at steps 1602 or 1604 is negative, the control proceeds to step 522 or 824 via step 1607 which is the same as step 1606. That is, in this case, the calculation of the second air-fuel ratio correction amount FAF2 (or the skip amounts RSR and RSL) is prohibited. As a result, as illustrated in FIGS. 19A, 19B, and 19C, when the amplitude of the output $V_2$ of the downstrem-side $O_2$ sensor 15 is relatively large, the amplitudes of the skip amounts RSR and RSL are not large enough for the amounts RSR and RSL to properly reach the maximum value MAX or the minimum value MIN.

Figure 20:
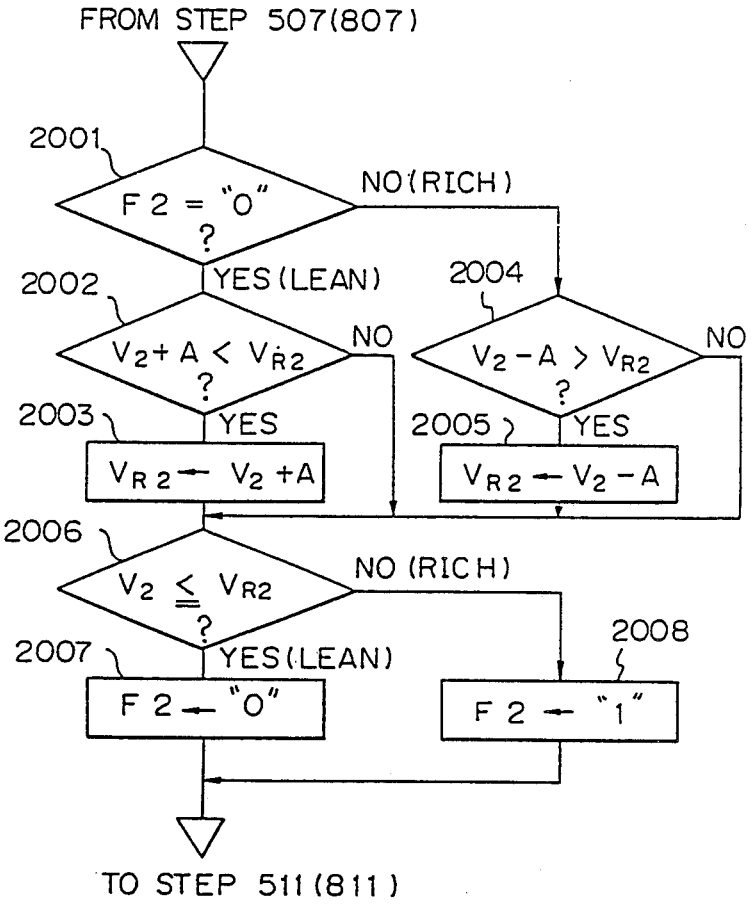

In order to substantially enhance the response speed of the downstream-side $O_2$ sensor 15, it is possible to change the reference voltage $V_{R2}$ in accordance with the output of the downstream-side $O_2$ sensor 15. That is, as illustrated in FIG. 20, at step 2001, it is determined whether or not the second air-fuel ratio flag F2 is "0" (lean). As a result, if F2="0" (lean), the control proceeds to step 2002 which determines whether or not $$V_2+A<V_{R2}$$

is satisfied. Note that A is a constant or a predetermined value dependent upon an engine load parameter such as Q and Ne. As a result, only if $V_2+A<V_{R2}$, does the control proceed to step 2003, which renews the reference voltage $V_{R2}$ by $V_{R2}+V_2+A$. On the other hand, if F2="1" (rich), the control proceeds to step 2004 which determines whether or nor $$V_2-A>V_{R2}$$

is satisfied. As a result, only if $V_2-A>V_{R2}$, does the control proceed to step 2005, which renews the reference voltage $V_{R2}$ by $V_{R2}+V_2-A$.

Thus, the reference voltage $V_{R2}$ follows the output $V_2$ of the downstream-side $O_2$ sensor 15 with a difference defined by the value A. Note that the value A at steps 2002 and 2003 can be different from the value A at steps 2004 and 2005. Also, the value A can be adjusted in accordance with a desired air-fuel ratio in view of the response characteristics of the $O_2$ sensor 15.

At steps 2006 through 2008, the second air-fuel ratio flag F2 is calculated by using the renewed reference voltage $V_{R2}$. Note that steps 2006 through 2008 correspond to steps 508 through 510 of FIG. 5 or steps 808 through 810 of FIG. 8.

Figures 21A, 21B, 21C:
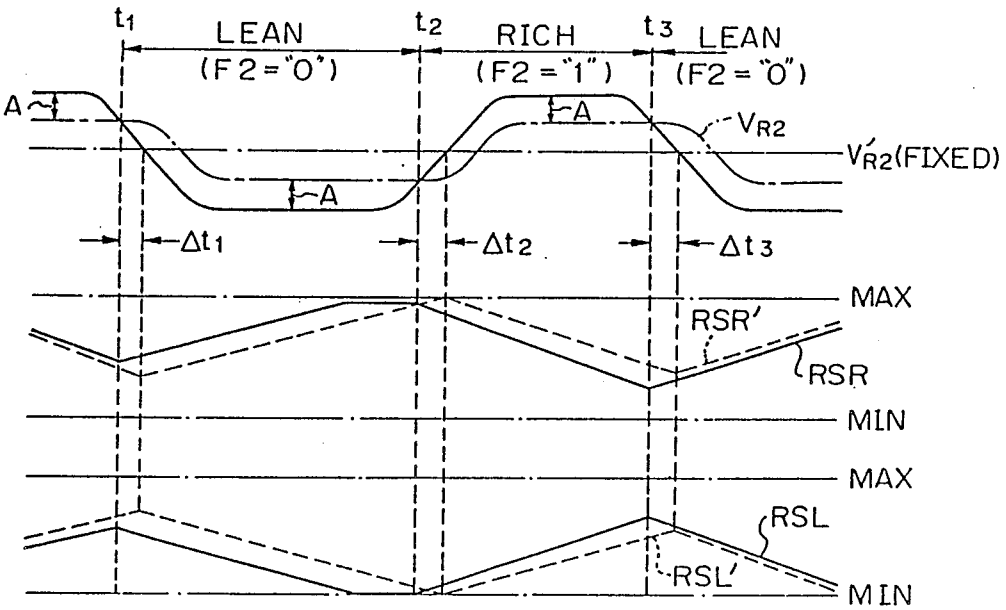
FIGS. 21A, 21B, and 21C are timing diagrams explaining the flow chart of FIG. 20.

The combination of the routines of FIGS. 9 and 20 will be explained with reference to FIGS. 21A, 21B, and 21C. As illustrated in FIG. 21A, when the output $V_2$ of the downstream-side $O_2$ sensor 15 is changed, the reference voltage $V_{R2}$ follows the output $V_2$. As a result, when the output $V_2$ of the downstream-side $O_2$ sensor 15 crosses the reference voltage $V_{R2}$ at times $t_1$, $t_2$, $t_3$, . . . , the second air-fuel ratio flag F2 is caused to be "0" (lean) at times $t_1$, $t_3$, . . . , and is caused to be "1" (rich) at times $t_2$, . . . . As a result, as illustrated in FIG. 21B and 21C, when F2="0", the rich skip amount RSR is gradually increased and the lean skip amount RSL is gradually decreased, but when F2="1", the rich skip amount RSR is gradually decreased and the lean skip amount RSL is gradually increased.

Thus, a transition of the air-fuel ratio downstream of the catalyst converter 12 from the rich side to the lean side or vice versa can be also detected earlier by $\Delta t_1$, $\Delta t_2$, $\Delta t_3$, . . . compared with the case where a fixed reference level $V_{R2}'$ is provided to obtain the rich skip amount RSR' and the lean skip amount RSL'. This means that the response speed of the downstream-side $O_2$ sensor 15 is substantially increased.

Figure 22:
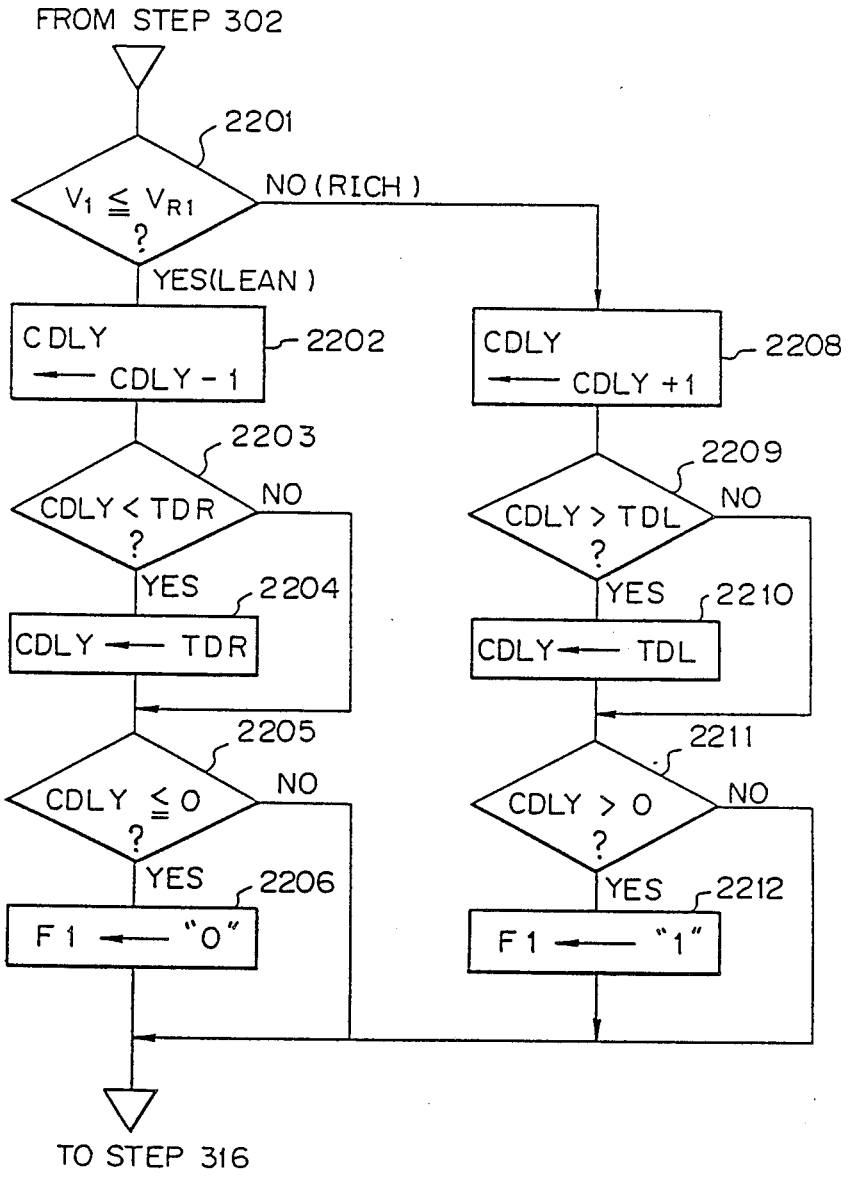

In FIG. 22, which is a modification of FIG. 3, a delay operation different from that of FIG. 3 is carried out. That is, at step 2201, if $V_1 \leqq V_{R1}$, which means that the current air-fuel ratio is lean, the control proceeds to steps 2202 which decreases a delay counter CDLY by 1. Then, at steps 2203 and 2204, the first delay counter CDLY is guarded by a minimum value TDR. Note that TDR is a rich delay time period for which a lean state is maintained even after the output of the upstream-side $O_2$ sensor 13 is changed from the lean side to the rich side, and is defined by a negative value.

Note that, in this case, if CDLY>0, then the delayed air-fuel ratio is rich, and if CDLY≦0, then the delayed air-fuel ratio is lean.

Therefore, at step 2205, it is determined whether or not CDLY≦0 is satisfied. As a result, if CDLY<0, at step 2206, the first air-fuel ratio flag F1 is caused to be "0" (lean). Otherwise, the first air-fuel ratio flag F1 is unchanged; that is, the flag F1 remains at "1".

On the other hand, if $V_1>V_{R1}$, which means that the current air-fuel ratio is rich, the control proceeds to step 2208 which increases the first delay counter CDLY1 by 1. Then, at steps 2209 and 2210, the first delay counter CDLY is guarded by a maximum value TDL. Note that TDL is a lean delay time period for which a rich state is maintained even after the output of the upstream-side $O_2$ sensor 13 is changed from the rich side to the lean side, and is defined by a positive value.

Then, at step 2211, it is determined whether or not CDLY>0 is satisfied. As a result, if CDLY>0, at step 2212, the first air-fuel ratio flag F1 is caused to be "1" (rich). Otherwise, the first air-fuel ratio flag F1 is unchanged; that is, the flag F1 remains at "0".

Figures 23A, 23B, 23C, 23D:
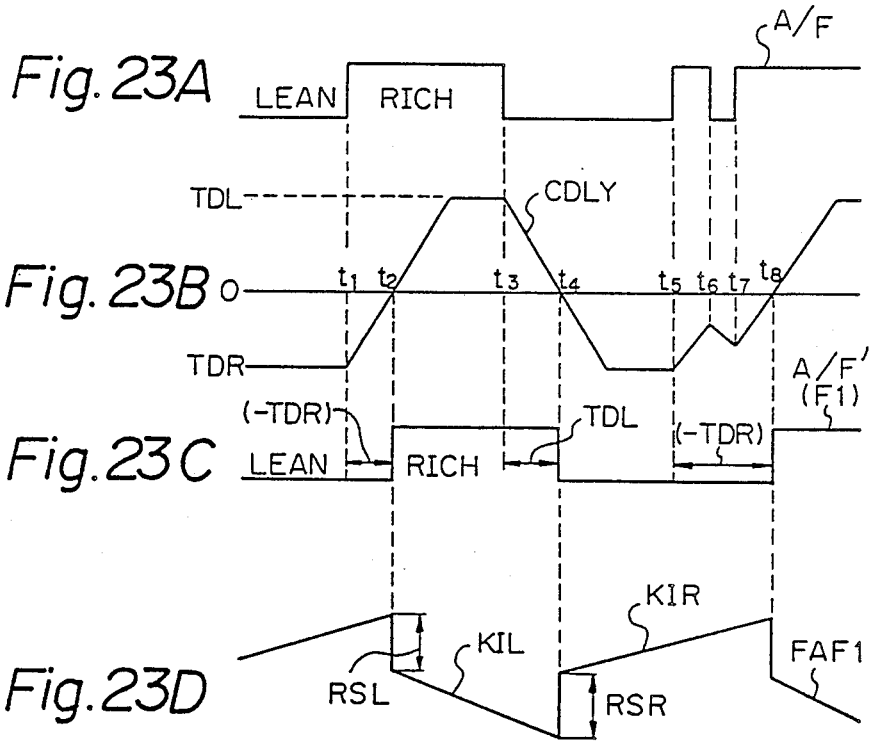
FIGS. 23A, 23B, 23C, and 23D are timing diagrams explaining the flow chart of FIG. 22.

The operation by the flow chart of FIG. 22 will be further explained with reference to FIGS. 23A through 23D. As illustrated in FIGS. 23A, when the air-fuel ratio A/F is obtained by the output of the upstream-side $O_2$ sensor 13, the delay counter CDLY is counted up during a rich state, and is counted down during a lean state, as illustrated in FIG. 23B. As a result, the delayed air-fuel ratio A/F' is obtained as illustrated in FIG. 23C. For example, at time $t_1$, even when the air-fuel ratio A/F is changed from the lean side to the rich side, the delayed air-fuel ratio A/F is changed at time $t_2$ after the rich delay time period TDR. Similarly, at time $t_3$, even when the air-fuel ratio A/F is changed from the rich side to the lean side, the delayed air-fuel ratio A/F' is changed at time $t_4$ after the lean delay time period TDL. However, at time $t_5$, $t_6$, or $t_7$, when the air-fuel ratio A/F is reversed within a smaller time period than the rich delay time period TDR or the lean delay time period TDL, the delayed air-fuel ratio A/F' is reversed at time $t_8$; that is, the delayed air-fuel ratio A/F' is stable when compared with the air-fuel ratio A/F. Further as illustrated in FIG. 23D, at every change of the delayed air-fuel ratio A/F' from the rich side to the lean side, or vice versa, the correction amount FAF1 is skipped by the skip amount RSR or RSL, and in addition, the correction amount FAF1 is gradually increased or decreased in accordance with the delayed air-fuel ratio A/F'.

Note that, in this case, during an open-control mode, the rich delay time period TDR is, for example, −12 (48 ms), and the lean delay time period TDL is, for example, 6 (24 ms).

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR and TDL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 601 of FIG. 6 or at step 901 or FIG. 9 is determined by the carburetor itself, i.e., the intake air negative pressure and the engine speed, and the air amount corresponding to TAU at step 603 of FIG. 6 or at step 903 of FIG. 9.

Further, a CO sensor, a lean-mixture sensor or the like can be also used instead of the $O_2$ sensor.

As explained above, according to the present invention, even when the air-fuel ratio correction amount FAF is held at a maximum or minimum value, the double air-fuel ratio sensor system exhibits the essential effect required thereof thus improving the emission characteristics, the fuel consumption, and the drivability.

We claim:

1. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio correction amount in accordance with the outputs of said upstream-side and downstream-side air-fuel ratio sensors;

guarding said air-fuel ratio correction amount within a predetermined range;

adjusting an actual air-fuel ratio in accordance with said air-fuel ratio correction amount;

determining whether or not said air-fuel ratio correction amount reaches a maximum or minimum value of said predetermined range; and prohibiting a calculation of said air-fuel ratio correction amount by the output of said downstream-side air-fuel ratio sensor while carrying out a correction of said air-fuel ratio correction amount by the output of said upstream-side air-fuel ratio ratio sensor when said air-fuel ratio correction amount reaches the maximum or minimum value of said predetermined range.

2. A method as set forth in claim 1, wherein said air-fuel ratio correction amount calculating step comprises the steps of:

calculating a first air-fuel ratio correction amount in accordance with the output of said upstream-side air-fuel ratio sensor; and calculating a second air-fuel ratio correction amount in accordance with the output of said downstream-side air-fuel ratio sensor, thereby calculating said air-fuel ratio correction amount in accordance with said first and second air-fuel ratio correction amounts.

3. A method as set forth in claim 2, wherein said second air-fuel ratio correction amount calculating step comprises the steps of:

determining whether or not the output of said downstream-side air-fuel ratio sensor indicates a rich level, by comparing this output with a rich determination level when the output of said downstream-side air-fuel ratio sensor indicates a lean level; and determining whether or not the output of said downstream-side air-fuel ratio sensor indicates a lean level by comparing this output with a lean determination level which is different from said rich determination level, when the output of said downstream-side air-fuel ratio sensor indicates a lean level, thereby calculating said second air-fuel ratio correction amount in accordance with whether the output of said downstream-side air-fuel ratio sensor indicates a rich level or a lean level.

4. A method as set forth in claim 3, wherein said rich determination level is lower than said lean determination level, in the case where the output of said downstream-side air-fuel ratio sensor is at a low level when the air-fuel ratio is lean and the output of said downstream-side air-fuel ratio sensor is at a high level when the air-fuel ratio is rich.

5. A method as set forth in claim 3, wherein said rich determination level is higher than said lean determination level, in the case where the output of said downstream-side air-fuel ratio sensor is at a high level when the air-fuel ratio is lean and the output of said downstream-side air-fuel ratio sensor is at a low level when the air-fuel ratio is rich.

6. A method as set forth in claim 2, wherein said second air-fuel ratio correction amount calculating step comprises the steps of:

determining whether the output of said downstream-side air-fuel ratio sensor is ascending or descending;

determining whether or not the output of said downstream-side air-fuel ratio sensor indicates a rich level by comprising this output with a rich determination level, when the output of said downstream-side air-fuel ratio sensor is in one of the ascending and descending state; and determining whether or not the output of said downstream-side air-fuel ratio sensor indicates a lean level by comparing this output with a lean determination level which is different from said rich determination level, when the output of said downstream-side air-fuel ratio sensor is in the other of the ascending and descending states, thereby calculating said second air-fuel ratio correction amount in accordance with whether the output of said downstream-side air-fuel ratio sensor indicates a rich level or a lean level.

7. A method as set forth in claim 6, wherein said rich determining step further comprises a step of determining whether or not the output of said downstream-side air-fuel ratio sensor indicates a lean level by comparing this output with said rich determination level; and wherein said lean determining step further comprises a step of determining whether or not the output of said downstream-side air-fuel ratio sensor indicates a rich level by comparing this output with said lean determination level.

8. A method as set forth in claim 6, wherein said rich determination level is lower than said lean determination level, in the case where the output of said downstream-side air-fuel ratio sensor is at a low level when the air-fuel ratio is lean and the output of said downstream-side air-fuel ratio sensor is at a high level when the air-fuel ratio is rich, and said method further comprising the steps of:

carrying out said rich determining step when the output of said downstream-side air-fuel ratio sensor is ascending; and carrying out said lean determining step when the output of said downstream-side air-fuel ratio sensor is descending.

9. A method as set forth in claim 6, wherein said rich determination level is higher than said lean determination level, in the case where the output of said downstream-side air-fuel ratio sensor is at a high level when the air-fuel ratio is lean and the output of said downstream-side air-fuel ratio sensor is at a low level when the air-fuel ratio is rich, and said method further comprising the steps of:

carrying out said rich determining step when the output of said downstream-side air-fuel ratio sensor is descending; and carrying out said lean determining step when the output of said downstream-side air-fuel ratio sensor is ascending.

10. A method as set forth in claim 6, further comprising the steps of:

prohibiting the calculation of said second air-fuel ratio correction amount when the output of said downstream-side air-fuel ratio sensor indicates said lean level, when the output of said downstream-side air-fuel ratio sensor is in one of the ascending and descending states; and prohibiting the calculation of said second air-fuel ratio correction amount when the output of said downstream-side air-fuel ratio sensor indicates said rich level, when the output of said downstream-side air-fuel ratio sensor is in the other of the ascending and descending states.

11. A method as set forth in claim 2, wherein said second air-fuel ratio correction amount calculating step comprises the steps of:

comparing the output of said downstream-side air-fuel ratio sensor with a reference voltage; and renewing said reference voltage in accordance with the output of said downstream-side air-fuel ratio sensor, thereby calculating said second air-fuel ratio correction amount in accordance with the comparison result of the output of said downstream-side air-fuel ratio sensor with said reference voltage.

12. A method as set forth in claim 11, wherein said reference voltage renewing step comprises the steps of:

determining whether or not the output of said downstream-side air-fuel ratio sensor is higher than said reference voltage;

subtracting a first predetermined value from the output of said downstream-side air-fuel ratio sensor to obtain a first value, when the output of said downstream-side air-fuel ratio sensor is higher than said reference voltage;

replacing said reference voltage with said first value only when said first value is higher than said reference voltage;

adding a second predetermined value to the output of said downstream-side air-fuel ratio sensor to obtain a second value, when the output of said downstream-side air-fuel ratio sensor is not higher than said reference voltage;

replacing said reference voltage with said second value only when said first value is lower than said reference voltage.

13. A method as set forth in claim 12, wherein said first and second predetermined values are dependent upon a load parameter of said engine.

14. A method as set forth in claim 1, wherein said air-fuel ratio correction amount calculating step comprises a step of calculating an air-fuel ratio feedback control parameter in accordance with the output of said downstream-side air-fuel ratio sensor, thereby calculating said air-fuel ratio correction amount in accordance with the output of said upstream-side air-fuel ratio sensor and said air-fuel ratio feedback control parameter.

15. A method as set forth in claim 14, wherein said air-fuel ratio feedback control parameter calculating step comprises the steps of:

determining whether or not the output of said downstream-side air-fuel ratio sensor indicates a rich level by comparing this output with a rich determination level, when the output of said downstream-side air-fuel ratio sensor indicates a lean level; and determining whether or not the output of said downstream-side air-fuel ratio sensor indicates a lean level by comparing this output with a lean determination level which is different from said rich determination level, when the output of said downstream-side air-fuel ratio sensor indicates a lean level, thereby calculating said air-fuel ratio feedback control amount in accordance with whether the output of said downstream-side air-fuel ratio sensor indicates a rich level or a lean level.

16. A method as set forth in claim 15, wherein said rich determination level is lower than said lean determination level, in the case where the output of said downstream-side air-fuel ratio sensor is at a low level when the air-fuel ratio is lean and the output of said downstream-side air-fuel ratio sensor is at a high level when the air-fuel ratio is rich.

17. A method as set forth in claim 15, wherein said rich determination level is higher than said lean determination level, in the case where the output of said downstream-side air-fuel ratio sensor is at a high level when the air-fuel ratio is lean and the output of said downstream-side air-fuel ratio sensor is at a low level when the air-fuel ratio is rich.

18. A method as set forth in claim 14, wherein said air-fuel ratio feedback control parameter calculating step comprises the steps of:

determining whether the output of said downstream-side air-fuel ratio sensor is ascending or descending;

determining whether or not the output of said downstream-side air-fuel ratio sensor indicates a rich level by comparing this output with a rich determination level, when the output of said downstream-side air-fuel ratio sensor is in one of the ascending and descending states; and determining whether or not the output of said downstream side air-fuel ratio sensor indicates a lean level by comparing this output with a lean determination level which is different from said rich determination level, when the output of said downstream-side air-fuel ratio sensor is in the other of the ascending and descending states, thereby calculating said air-fuel ratio feedback control in accordance with whether the output of said downstream-side air-fuel ratio sensor indicates a rich level or a lean level.

19. A method as set forth in claim 18, wherein said rich determining step further comprises a step of determining whether or not the output of said downstream-side air-fuel ratio sensor indicates a lean level by comparing this output with said rich determination level; and wherein said lean determinining step further comprises a step of determining whether or not the output of said downstream-side air fuel ratio sensor indicates a rich level by comparing this output with said lean determination level.

20. A method as set forth in claim 18, wherein said rich determination level is lower than said lean determination level, in the case where the output of said downstream-side air-fuel ratio sensor is at a low level when the air-fuel ratio is lean and the output of said downstream-side air-fuel ratio sensor is at a high level when the air-fuel ratio is rich, and said method further comprising the steps of:

carrying out said rich determining step when the output of said downstream-side air-fuel ratio sensor is ascending; and carrying out said lean determining step when the output of said downstream-side air-fuel ratio sensor is descending,

21. A method as set forth in claim 18, wherein said rich determination level is higher than said lean determination level, in the case where the output of said downstream-side air-fuel ratio sensor is at a high level when the air-fuel ratio is lean and the output of said downstream-side air-fuel ratio sensor is at a low level when the air-fuel ratio is rich, and said method further comprising the steps of:

carrying out said rich determining step when the output of said downstream-side air-fuel ratio sensor is descending; and carrying out said lean determining step when the output of said downstream-side air-fuel ratio sensor is ascending.

22. A method as set forth in claim 18, further comprising the steps of:

prohibiting the calculation of said air-fuel ratio feedback control parameter when the output of said downstream-side air-fuel ratio sensor indicates said lean level, when the output of said downstream-side air-fuel ratio sensor is in one of the ascending and descending states; and prohibiting the calculation of said air-fuel ratio feedback control parameter when the output of said downstream-side air-fuel ratio sensor indicates said rich level, when the output of said downstream-side air-fuel ratio sensor is in the other of the ascending and descending states,

23. A method as set forth in claim 14, wherein said air-fuel ratio feedback control parameter calculating step comprises the steps of:

comparing the output of said downstream-side air-fuel ratio sensor with a reference voltage; and renewing said reference voltage in accordance with the output of said downstream-side air-fuel ratio sensor, thereby calculating said air-fuel ratio feedback control parameter in accordance with the comparison result of the output of said downstream-side air-fuel ratio sensor with said reference voltage.

24. A method as set forth in claim 23, wherein said reference voltage renewing step comprises the steps of:

determining whether or not the output of said downstream-side air-fuel ratio sensor is higher than said reference voltage;

subtracting a first predetermined value from the output of said downstream-side air-fuel ratio sensor to obtain a first value, when the output of said downstream-side air-fuel ratio sensor is higher than said reference voltage;

replacing said reference voltage with said first value only when said first value is higher than said reference voltage;

adding a second predetermined value to the output of said downstream-side air-fuel ratio sensor to obtain a second value, when the output of said downstream-side air-fuel ratio sensor is not higher than said reference voltage;

replacing said reference voltage with said second value only when said first value is lower than said reference voltage.

25. A method as set forth in claim 24, wherein said first and second predetermined values are dependent upon a load parameter of said engine.

26. A method as set forth in claim 14, wherein said air-fuel ratio feedback control parameter is defined by a lean skip amount by which said air-fuel ratio correction amount is skipped down when the output of said upstream-side air-fuel ratio sensor is switched from the lean side of the rich side and a rich skip amount by which said air-fuel ratio correction amount is skipped up when the output of said downstream-side air-fuel ratio sensor is switched from the rich side to the lean side.

27. A method as set forth in claim 14, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

28. A method as set forth in claim 14, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

29. A method as set forth in claim 14, wherein said air-fuel ratio feedback control parameter is determined by a reference voltage with which the output of said upstream-side air-fuel ratio sensor is compared, thereby determining whether the air-fuel ratio is on the rich side or on the lean side.

30. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio correction amount in accordance with the outputs of said upstream-side and downstream-side air fuel ratio sensors;

means for guarding said air-fuel ratio correction amount within a predetermined range;

means for adjusting an actual air-fuel ratio in accordance with said air-fuel ratio correction amount;

means for determining whether or not said air-fuel ratio correction amount reaches a maximum or minimum value of said predetermined range; and means for prohibiting a calculation of said air-fuel ratio correction amount by the output of said downstream-side air-fuel ratio sensor and carrying out a correction of said air-fuel ratio correction amount by the output of said upstream-side air-fuel ratio sensor when said air-fuel ratio correction amount reaches the maximum or minimum value of said predetermined range.

31. An apparatus as set forth in claim 30, wherein said air-fuel ratio correction amount calculating means comprises:

means for calculating a first air-fuel ratio correction amount in accordance with the output of said upstream-side air-fuel ratio sensor; and means for calculating a second air-fuel ratio correction amount in accordance with the output of said downstream-side air-fuel ratio sensor, thereby calculating said air-fuel ratio correction amount in accordance with said first and second air-fuel ratio correction amounts.

32. An apparatus as set forth in claim 31, wherein said second air-fuel ratio correction amount calculating step comprises:

means for determining whether or not the output of said downstream-side air-fuel ratio sensor indicates a rich level by comparing this output with a rich determination level, when the output of said downstream-side air-fuel ratio sensor indicates a lean level; and means for determining whether or not the output of said downstream-side air-fuel ratio sensor indicates a lean level by comparing this output with a lean determination level which is different from said rich determination level, when the output of said downstream-side air-fuel ratio sensor indicates a lean level, thereby calculating said second air-fuel ratio correction amount in accordance with whether the output of said downstream-side air-fuel ratio sensor indicates a rich level or a lean level.

33. An apparatus as set forth in claim 32, wherein said rich determination level is lower than said lean determination level, in the case where the output of said downstream-side air-fuel ratio sensor is at a low level when the air-fuel ratio is lean and the output of said downstream-side air-fuel ratio sensor is at a high level when the air-fuel ratio is rich.

34. An apparatus as set forth in claim 32, wherein said rich determination level is higher than said lean determination level, in the case where the output of said downstream-side air-fuel ratio sensor is at a high level when the air-fuel ratio is lean and the output of said downstream-side air-fuel ratio sensor is at a low level when the air-fuel ratio is rich.

35. An apparatus as set forth in claim 31, wherein said second air-fuel ratio correction amount calculating step comprises:

means for determining whether the output of said downstream-side air-fuel ratio sensor is ascending or descending;

means for determining whether or not the output of said downstream-side air-fuel ratio sensor indicates a rich level by comparing this output with a rich determination level, when the output of said downstream-side air-fuel ratio sensor is in one of the ascending and descending states; and means for determining whether or not the output of said downstream-side air-fuel ratio sensor indicates a lean level by comparing this output with a lean determination level which is different from said rich determination level, when the output of said downstream-side air-fuel ratio sensor is in the other of the ascending and descending states, thereby calculating a said second air-fuel ratio correction amount in accordance with whether the output of said downstream-side air-fuel ratio sensor indicates a rich level or a lean level.

36. An apparatus as set forth in claim 35, wherein said rich determining step further comprises a step of determining whether or not the output of said downstream-side air-fuel ratio sensor indicates a lean level by comparing this output with said rich determination level; and wherein said lean determining step further comprises a step of determining whether or not the output of said downstream-side air-fuel ratio sensor indicates a rich level by comparing this output with said lean determination level.

37. An apparatus as set forth in claim 35, wherein said rich determination level is lower than said lean determination level, in the case where the output of said downstream-side air-fuel ratio sensor is at a low level when the air-fuel ratio is lean and the output of said downstream-side air-fuel ratio sensor is at a high level when the air-fuel ratio is rich, and said apparatus further comprising:

means for carrying out said rich determining means when the output of said downstream-side air-fuel ratio sensor is ascending; and means for carrying out said lean determining means when the output of said downstream-side air-fuel ratio sensor is descending.

38. An apparatus as set forth in claim 35, wherein said rich determination level is higher than said lean determination level, in the case where the output of said downstream-side air-fuel ratio sensor is at a high level when the air-fuel ratio is lean and the output of said downstream-side air-fuel ratio sensor is at a low level when the air-fuel ratio is rich, and said apparatus further comprising;

means for carrying out said rich determining means when the output of said downstream-side air-fuel ratio sensor is descending; and means for carrying out said lean determining means when the output of said downstream-side air-fuel ratio sensor is ascending.

39. An apparatus as set forth in claim 35, further comprising:

means for prohibiting the calculation of said second air-fuel ratio correction amount when the output of said downstream-side air-fuel ratio sensor indicates said lean level, when the output of said downstream-side air-fuel ratio sensor is in one of the ascending and descending states; and means for prohibiting the calculation of said second air-fuel ratio correction amount when the output of said downstream-side air-fuel ratio sensor indicates said rich level, when the output of said downstream-side air-fuel ratio sensor is in the other of the ascending and descending states.

40. An apparatus as set forth in claim 31, wherein said second air-fuel ratio correction amount calculating means comprises:

means for comparing the output of said downstream-side air-fuel ratio sensor with a reference voltage; and means for renewing said reference voltage in accordance with the output of said downstream-side air-fuel ratio sensor, thereby calculating said second air-fuel ratio correction amount in accordance with the comparison result of the output of said downstream-side air-fuel ratio sensor with said reference voltage.

41. An apparatus as set forth in claim 40, wherein said reference voltage renewing means comprises:

means for determining whether or not the output of said downstream-side air-fuel ratio sensor is higher than said reference voltage;

means for subtracting a first predetermined value from the output of said downstream-side air-fuel ratio sensor to obtain a first value, when the output of said downstream-side air-fuel ratio sensor is higher than said reference voltage;

means for replacing said reference voltage with said first value only when said first value is higher than said reference voltage;

means for adding a second predetermined value to the output of said downstream-side air-fuel ratio sensor to obtain a second value, when the output of said downstream-side air-fuel ratio sensor is not higher than said reference voltage;

means for replacing said reference voltage with said second value only when said first value is lower than said reference voltage.

42. An apparatus as set forth in claim 41, wherein said first and second predetermined values are dependent upon a load parameter of said engine.

43. An apparatus as set forth in claim 30, wherein said air-fuel ratio correction amount calculating means comprises means for calculating an air-fuel ratio feedback control parameter in accordance with the output of said downstream-side air-fuel ratio sensor, thereby calculating said air-fuel ratio correction amount in accordance with the output of said upstream-side air-fuel ratio sensor and said air-fuel ratio feedback control parameter.

44. An apparatus as set forth in claim 43, wherein said air-fuel ratio feedback control parameter calculating step comprises:

means for determining whether or not the output of said downstream-side air-fuel ratio sensor indicates a rich level by comparing this output with a rich determination level, when the output of said downstream-side air-fuel ratio sensor indicates a lean level; and means for determining whether or not the output of said downstream-side air-fuel ratio sensor indicates a lean level by comparing this output with a lean determination level which is different from said rich determination level, when the output of said downstream-side air-fuel ratio sensor indicates a lean level, thereby calculating said air-fuel ratio feedback control amount in accordance with whether the output of said downstream-side air-fuel ratio sensor indicates a rich level or a lean level.

45. An apparatus as set forth in claim 44, wherein said rich determination level is lower than said lean determination level, in the case where the output of said downstream-side air-fuel ratio sensor is at a low level when the air-fuel ratio is lean and the output of said downstream-side air-fuel ratio sensor is at a high level when the air-fuel ratio is rich.

46. An apparatus as set forth in claim 44, wherein said rich determination level is higher than said lean determination level, in the case where the output of said downstream-side air-fuel ratio sensor is at a high level when the air-fuel ratio is lean and the output of said downstream-side air-fuel ratio sensor is at a low level when the air-fuel ratio is rich.

47. An apparatus as set forth in claim 43, wherein said air-fuel ratio feedback control parameter calculating means comprises:

means for determining whether the output of said downstream-side air-fuel ratio sensor is ascending or descending;

means for determining whether or not the output of said downstream-side air-fuel ratio sensor indicates a rich level by comparing this output with a rich determination level, when the output of said downstream-side air-fuel ratio sensor is in one of the ascending and descending state; and means for determining whether or not the output of said downstream-side air-fuel ratio sensor indicates a lean level by comparing this output with a lean determination level which is different from said rich determination level, when the output of said downstream-side air-fuel ratio sensor is in the other of the ascending and descending states, thereby calculating said air-fuel ratio feedback control parameter in accordance with whether the output of said downstream-side air-fuel ratio sensor indicates a rich level or a lean level.

48. An apparatus as set forth in claim 47, wherein said rich determining means further comprises means for determining whether or not the output of said downstream-side air-fuel ratio sensor indicates a lean level by comparing this output with said rich determination level; and wherein said lean determining means further comprises means for determining whether or not the output of said downstream-side air-fuel ratio sensor indicates a rich level by comparing this output with said lean determination level.

49. An apparatus as set forth in claim 47, wherein said rich determination level is lower than said lean determination level, in the case where the output of said downstream-side air-fuel ratio sensor is at a low level when the air-fuel ratio is lean and the output of said downstream-side air-fuel ratio sensor is at a high level when the air-fuel ratio is rich, and said apparatus further comprising;

means for carrying out said rich determining step when the output of said downstream-side air-fuel ratio sensor is ascending; and means for carrying out said lean determining step when the output of said downstream-side air-fuel ratio sensor is descending.

50. An apparatus as set forth in claim 47, wherein said rich determination level is higher than said lean determination level, in the case where the output of said downstream-side air-fuel ratio sensor is at a high level when the air-fuel ratio is lean and the output of said downstream-side air-fuel ratio sensor is at a low level when the air-fuel ratio is rich, and said apparatus further comprising:

means for carrying out said rich determining means when the output of said downstream-side air-fuel ratio sensor is descending; and means for carrying out said lean determining means when the output of said downstream-side air-fuel ratio sensor is ascending.

51. An apparatus as set forth in claim 47, which further comprises a means for prohibiting the calculation of said air-fuel ratio feedback control parameter when the output of said downstream-side air-fuel ratio sensor indicates said lean level, when the output of said downstream-side air-fuel ratio sensor is in one of the ascending and descending states; and means for prohibiting the calculation of said air-fuel ratio feedback control parameter when the output of said downstream-side air-fuel ratio sensor indicates said rich level, when the output of said downstream-side air-fuel ratio sensor is in the other of the ascending and descending states.

52. An apparatus as set forth in claim 43, wherein said air-fuel ratio feedback control parameter calculating means comprises:

means for comparing the output of said downstream-side air-fuel ratio sensor with a reference voltage; and means for renewing said reference voltage in accordance with the output of said downstream-side air-fuel ratio sensor, thereby calculating said air-fuel ratio feedback control parameter in accordance with the comparison result of the output of said downstream-side air-fuel ratio sensor with said reference voltage.

53. An apparatus as set forth in claim 52, wherein said reference voltage renewing step comprises:

means for determining whether or not the output of said downstream-side air-fuel ratio sensor is higher than said reference voltage;

means for subtracting a first predetermined value from the output of said downstream-side air-fuel ratio sensor to obtain a first value, when the output of said downstream-side air-fuel ratio sensor is higher than said reference voltage;

means for replacing said reference voltage with said first value only when said first value is higher than said reference voltage;

means for adding a second predetermined value to the output of said downstream-side air-fuel ratio sensor to obtain a second value, when the output of said downstream-side air-fuel ratio sensor is not higher than said reference voltage;

means for replacing said reference voltage with said second value only when said first value is lower than said reference voltage.

54. An apparatus as set forth in claim 53, wherein said first and second predetermined values are dependent upon a load parameter of said engine.

55. A method as set forth in claim 43, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

56. A method as set forth in claim 43, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said usptream-side air-fuel ratio sensor is on the lean side.

57. A method as set forth in claim 43, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

58. A method as set forth in claim 43, wherein said air-fuel ratio feedback control parameter is determined by a reference voltage with which the output of said upstream-side air-fuel ratio sensor is compared, thereby determining whether the air-fuel ratio is on the rich side or on the lean side.

* * * * *